US008091995B2

(12) United States Patent
Shimizu et al.

(10) Patent No.: US 8,091,995 B2
(45) Date of Patent: Jan. 10, 2012

(54) LIQUID CONTAINER, CONTAINER HOLDER AND LIQUID CONSUMING APPARATUS

(75) Inventors: Kazutoshi Shimizu, Shimosuwa-machi (JP); Izumi Nozawa, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 434 days.

(21) Appl. No.: 11/855,263

(22) Filed: Sep. 14, 2007

(65) Prior Publication Data

US 2008/0284810 A1 Nov. 20, 2008

(30) Foreign Application Priority Data

Nov. 6, 2006 (JP) ..... 2006-300935

(51) Int. Cl.
*B41J 2/175* (2006.01)

(52) U.S. Cl. ..... 347/86; 347/20; 347/108; 347/49

(58) Field of Classification Search ..... 347/49, 347/20, 86, 108
See application file for complete search history.

(56) References Cited

U.S. PATENT DOCUMENTS

| | | | | |
|---|---|---|---|---|
| 4,277,791 | A | 7/1981 | Rosenstock et al. | |
| 4,367,383 | A | 1/1983 | Sommansson | |
| 4,467,159 | A | 8/1984 | Ota et al. | |
| 4,661,667 | A | 4/1987 | Sorimachi et al. | |
| 5,211,431 | A | 5/1993 | Koizumi et al. | |
| 5,291,224 | A | 3/1994 | Asano et al. | |
| 5,500,664 | A | 3/1996 | Suzuki et al. | |
| 5,642,143 | A | 6/1997 | Rhoads | |
| 5,666,146 | A * | 9/1997 | Mochizuki et al. | 347/86 |
| 5,699,091 | A | 12/1997 | Bullock et al. | |
| 5,745,139 | A | 4/1998 | Sasaki | |
| 5,798,775 | A | 8/1998 | Takahashi et al. | |
| 5,805,187 | A | 9/1998 | Sasaki | |

(Continued)

FOREIGN PATENT DOCUMENTS

CN 1 349 894 5/2002

(Continued)

OTHER PUBLICATIONS

European Patent Office, European Search Report, Nov. 6, 2009.

(Continued)

*Primary Examiner* — Ellen Kim
(74) *Attorney, Agent, or Firm* — Strock & Strock & Lavan LLP

(57) ABSTRACT

A liquid container that has a container body storing a liquid to be supplied to a liquid consuming apparatus and that is detachably mounted on a container mounting portion of the liquid consuming apparatus, wherein a liquid supply port for sending out the liquid to be supplied to the liquid consuming apparatus is formed on a front end surface in an insertion direction of the container body having a substantially rectangular shape, wherein a circuit board having a contact point with the liquid consuming apparatus is formed on one side surface perpendicular to one corresponding short side of the front end surface in the insertion direction, and wherein a container fixation structure for releasably regulating a movement of the container body in a direction opposite to the insertion direction thereof in cooperation with an apparatus fixation structure formed on the container mounting portion is formed on the other side surface perpendicular to the other corresponding short side of the front end surface in the insertion direction in a state where the container body is mounted on the container mounting portion against an urging force in the direction opposite to the insertion direction.

18 Claims, 16 Drawing Sheets

U.S. PATENT DOCUMENTS

| | | | | |
|---|---|---|---|---|
| 5,841,453 | A | 11/1998 | Sasaki | |
| 5,949,459 | A | 9/1999 | Gasvoda et al. | |
| 6,070,975 | A | 6/2000 | Uchikata et al. | |
| 6,130,695 | A | 10/2000 | Childers et al. | |
| 6,250,750 | B1 | 6/2001 | Miyazawa et al. | |
| 6,264,314 | B1 | 7/2001 | Mochizuki et al. | |
| 6,276,789 | B1 | 8/2001 | Miyazaki et al. | |
| 6,281,912 | B1 * | 8/2001 | Silverbrook | 347/42 |
| 6,286,949 | B1 | 9/2001 | Lewis et al. | |
| 6,290,332 | B1 | 9/2001 | Crystal et al. | |
| 6,302,535 | B1 | 10/2001 | Sturgeon et al. | |
| 6,312,084 | B1 | 11/2001 | Ujita et al. | |
| 6,402,298 | B1 | 6/2002 | Nanjo et al. | |
| 6,431,681 | B2 | 8/2002 | Hatasa et al. | |
| 6,431,697 | B1 | 8/2002 | King et al. | |
| 6,454,381 | B1 | 9/2002 | Olsen et al. | |
| 6,460,982 | B1 | 10/2002 | Ito et al. | |
| 6,467,869 | B1 | 10/2002 | Merz et al. | |
| 6,471,333 | B1 | 10/2002 | Powell et al. | |
| 6,502,917 | B1 | 1/2003 | Shinada et al. | |
| 6,536,888 | B2 | 3/2003 | Trafton et al. | |
| 6,554,402 | B2 | 4/2003 | Trafton et al. | |
| 6,582,068 | B2 | 6/2003 | Ishizawa et al. | |
| 6,679,584 | B2 * | 1/2004 | Silverbrook | 347/42 |
| 6,722,762 | B2 | 4/2004 | Miyazawa et al. | |
| 6,742,872 | B2 | 6/2004 | Fukazawa et al. | |
| 6,749,292 | B2 | 6/2004 | Sturgeon et al. | |
| 6,755,514 | B2 | 6/2004 | Koga et al. | |
| 6,755,516 | B2 | 6/2004 | Hanson et al. | |
| 6,758,556 | B2 | 7/2004 | Ishizawa et al. | |
| 6,773,100 | B2 | 8/2004 | Kulpa et al. | |
| 6,817,699 | B2 | 11/2004 | Hirashima et al. | |
| 6,832,830 | B2 | 12/2004 | Seino et al. | |
| 6,834,945 | B2 | 12/2004 | Ishizawa et al. | |
| 6,843,558 | B2 | 1/2005 | Seino | |
| 6,886,928 | B2 | 5/2005 | Sasaki et al. | |
| 7,018,027 | B2 | 3/2006 | Harada et al. | |
| 7,244,018 | B2 * | 7/2007 | Hashii et al. | 347/86 |
| 7,448,734 | B2 * | 11/2008 | Silverbrook | 347/85 |
| 7,566,106 | B2 * | 7/2009 | Silverbrook et al. | 347/7 |
| 2002/0071011 | A1 | 6/2002 | Hayashi et al. | |
| 2002/0085075 | A1 | 7/2002 | Shinada et al. | |
| 2002/0109761 | A1 | 8/2002 | Shimizu et al. | |
| 2002/0196312 | A1 | 12/2002 | Ishizawa et al. | |
| 2004/0021737 | A1 | 2/2004 | Harada et al. | |
| 2004/0021738 | A1 | 2/2004 | Suganuma | |
| 2004/0210424 | A1 * | 10/2004 | Seino et al. | 702/189 |
| 2004/0212661 | A1 | 10/2004 | Tsuruma | |
| 2005/0036015 | A1 | 2/2005 | Seino et al. | |
| 2005/0052511 | A1 | 3/2005 | Seino et al. | |
| 2005/0068382 | A1 | 3/2005 | Kimura et al. | |
| 2005/0116998 | A1 | 6/2005 | Harada et al. | |
| 2005/0185036 | A1 | 8/2005 | Seino et al. | |
| 2005/0248637 | A1 | 11/2005 | Seino et al. | |
| 2006/0152564 | A1 * | 7/2006 | Hashii et al. | 347/86 |
| 2007/0222833 | A1 * | 9/2007 | Ishizawa et al. | 347/85 |
| 2009/0262154 | A1 * | 10/2009 | Silverbrook et al. | 347/7 |

FOREIGN PATENT DOCUMENTS

| | | | |
|---|---|---|---|
| DE | 28 12 562 | A1 | 9/1979 |
| DE | 35 45 621 | A1 | 6/1986 |
| DE | 90 18 060.7 | | 8/1990 |
| DE | 103 27 251 | A1 | 2/2004 |
| DE | 299 24 675 | | 9/2004 |
| EP | 0 412 459 | | 2/1991 |
| EP | 0 496 642 | A2 | 7/1992 |
| EP | 0 829 363 | A2 | 3/1998 |
| EP | 0 997 297 | A1 | 5/2000 |
| EP | 1 000 749 | A2 | 5/2000 |
| EP | 1 122 076 | A1 | 8/2001 |
| EP | 1 177 904 | A1 | 2/2002 |
| EP | 1 199 179 | A1 | 4/2002 |
| EP | 1 213 148 | A1 | 6/2002 |
| EP | 1 247 651 | | 10/2002 |
| EP | 1 323 533 | A2 | 7/2003 |
| EP | 1 354 709 | | 10/2003 |
| EP | 1 375 159 | A1 | 1/2004 |
| EP | 1375159 | | 1/2004 |
| EP | 1375159 | A1 * | 1/2004 |
| EP | 1 457 341 | A2 | 9/2004 |
| EP | 1 623 834 | A1 | 2/2006 |
| FR | 2 837 422 | | 9/2003 |
| GB | 1164260 | | 9/1969 |
| GB | 2 241 201 | A | 8/1991 |
| GB | 2 315 045 | A | 1/1998 |
| GB | 2 321 623 | A | 8/1998 |
| GB | 2 343 145 | A | 5/2000 |
| GB | 2 387 567 | A | 10/2003 |
| GB | 2 391 200 | A | 4/2004 |
| JP | 60-133071 | U | 9/1985 |
| JP | 61-059054 | U | 4/1986 |
| JP | 63-271676 | A | 11/1988 |
| JP | 1-141750 | A | 6/1989 |
| JP | 02-88248 | A | 3/1990 |
| JP | 3-13628 | | 2/1991 |
| JP | 3-108557 | | 5/1991 |
| JP | 3-108557 | A | 5/1991 |
| JP | 03-193480 | | 8/1991 |
| JP | 03-197782 | A | 8/1991 |
| JP | 03-246039 | A | 11/1991 |
| JP | 4-247955 | A | 9/1992 |
| JP | 04-268686 | A | 9/1992 |
| JP | 04-119078 | U | 10/1992 |
| JP | 06-023757 | U | 3/1994 |
| JP | 06-064185 | A | 3/1994 |
| JP | 08-169121 | A | 7/1996 |
| JP | 09-011500 | | 1/1997 |
| JP | 09-123479 | | 5/1997 |
| JP | 09-167033 | A | 6/1997 |
| JP | 09-309213 | | 12/1997 |
| JP | 10-006611 | A | 1/1998 |
| JP | 10-109427 | | 4/1998 |
| JP | 10-235888 | | 9/1998 |
| JP | 2000-309107 | | 11/2000 |
| JP | 2001-58417 | A | 6/2001 |
| JP | 2001-150691 | | 6/2001 |
| JP | 2001-260373 | | 9/2001 |
| JP | 2001-267013 | | 9/2001 |
| JP | 2001-277541 | | 10/2001 |
| JP | 2001-341323 | | 11/2001 |
| JP | 2002-019135 | | 1/2002 |
| JP | 2002-019227 | A | 1/2002 |
| JP | 2002-31108 | | 1/2002 |
| JP | 2002-044828 | A | 2/2002 |
| JP | 2002-127546 | A | 5/2002 |
| JP | 2002-513340 | T | 5/2002 |
| JP | 2002-513341 | T | 5/2002 |
| JP | 2002-240260 | A | 8/2002 |
| JP | 2002-254673 | | 9/2002 |
| JP | 2002-273889 | A | 9/2002 |
| JP | 2003-341100 | A | 12/2002 |
| JP | 2003-19817 | | 1/2003 |
| JP | 2003-175589 | | 6/2003 |
| JP | 2003-200590 | | 7/2003 |
| JP | 2004-66490 | A | 3/2004 |
| JP | 2004-74773 | A | 3/2004 |
| JP | 2005-088575 | A | 4/2005 |
| WO | 98/55318 | | 12/1998 |
| WO | 98/55324 | | 12/1998 |
| WO | 99/59823 | | 11/1999 |
| WO | 01/49499 | A1 | 7/2001 |
| WO | 2004/098895 | A1 | 11/2004 |

OTHER PUBLICATIONS

Australian Patent Office—First Report on Patent Application No. 2004203638—Oct. 12, 2009.

European Patent Office—Office Action Pursuant to Article 96(2) EPC—Sep. 13, 2006.

Office Action, dated Nov. 18, 2009, for German Application No. 10 2004 038 382.0-26.

Office Action, dated Feb. 17, 2010 for Japanese Appln. No. 2004-194203 with partial translation.

Office Action, dated Feb. 17, 2010 for Japanese Appln. No. 2004-194236 with partial translation.

U.S. Appl. No. 11/866,131.

Office Action, dated Aug. 25, 2009, for Japanese Application No. 2003-290713 (English Translation of Reason 2).

Office Action issued by the Mexican Patent Office (Instituto Mexicano de la Propiedad Industrial) on Mar. 26, 2010. A partial English translation is included in the attached letter from Mexican Patent Counsel.

Partial translation of an Office Action issued by the Japanese Patent Office on Apr. 6, 2010.

Office Action dated Mar. 29, 2010, in the related U.S. Appl. No. 11/866,131.

Office Action for Japanese Patent Appln. No. 2003-168570, dated Jun. 9, 2009, and partial English translation thereof.

English language version of Office Action for Chinese Appln. 2007 10107316.0, Mar. 13, 2009.

International Search Report, IPRP and Written Opinion in PCT/JP2007/067982.

Vietnamese Office Action dated Dec. 1, 2010 of VN 1-2009-00728 patent application.

Office Action issued on Dec. 15, 2010 for New Zealand Patent Appln. No. 576676.

Office Action dated May 31, 2011 and its English translation in Japanese Patent Appln. No. 2008-543011.

Office Action dated Jun. 6, 2011 in European Patent Appln. No. 07024307.6.

* cited by examiner

LIQUID CONTAINER, CONTAINER HOLDER AND LIQUID CONSUMING APPARATUS

BACKGROUND

1. Technical Field

The present invention relates to a liquid container for storing a liquid supplied to a liquid consuming apparatus in a container body and being detachably mounted on a container mounting portion of the liquid consuming apparatus, a container holder for accommodating the liquid container, and the liquid container.

2. Related Art

Exemplary liquid consuming apparatuses capable of ejecting liquid droplets from a liquid ejecting head include an ink jet printing apparatus mounted with an ink jet printing head for an image printing, a device mounted with a color material ejecting head used to manufacture a color filter such as liquid crystal display, a device mounted with an electrode material (conductive paste) ejecting head used to form an electrode such as an organic EL display or a field emission display (FED), a device mounted with a living-body organic matter ejecting head used to manufacture a bio chip, a device mounted with a sample ejecting head which is a precise pipette, and the like.

In particular, since the ink jet printing apparatus causes relatively small noise and can also form small dots with a high density in a printing, the ink jet printing apparatus has been recently used for the many printings including a color printing. As a type of supplying a liquid to the ink jet printing apparatus, there is a so-called cartridge type in which the liquid is supplied from a liquid container storing the liquid to the liquid consuming apparatus. The cartridge type is configured so that the liquid container is simply attached to or detached from the liquid consuming apparatus in order for a user to exchange the liquid container when the liquid contained in the liquid container are completely consumed.

In this type of liquid container, a circuit board mounted with a memory element (IC) for storing information on a ink type, a amount of residual liquid or the like may be formed on an outer surface thereof. In this case, an apparatus terminal of the liquid consuming apparatus connected to a contact point of the circuit board is formed in a container holder of the liquid consuming apparatus mounted with the liquid container. When the liquid container including such a circuit board is mounted on the container holder, it is necessary to reliably connect the contact point of the circuit board to the apparatus terminal of the liquid consuming apparatus. That is, it is necessary to connect the apparatus terminal to the contact point of the circuit board so as to be electrically connected to each other.

Some known liquid containers and container holders include, for example, a container fixation structure for releasably regulating a movement of the liquid container in a pulling direction of the liquid container in cooperation with an apparatus fixation structure formed in the container holder as a mechanism for firmly fixing the liquid container to a predetermined position of the container holder (for example, see Patent Document 1).

The container fixation structure includes a guide groove for releasably regulating the movement of the liquid container at a position opposite to an insertion direction of the liquid container in cooperation with a locking pin of the apparatus fixation structure disposed in the container mounting portion when the liquid container is mounted in the container mounting portion against an urging force in the direction opposite to the insertion direction.

When the liquid container is fixed to the container holder, the liquid container is inserted into the container mounting portion, further pushed against the urging force in the direction opposite to the insertion direction by a slider member, and then a pressing force is released, the locking pin of the apparatus fixation structure is moved to a lock position of the guide groove and the liquid container is fixed.

In addition, when the liquid container is detached from the container holder, the container is pushed into the container mounting portion so that the locking pin is moved to a non-lock position of the guide groove. Accordingly, when the pressing force is released, the container is urged so as to be taken out in the direction opposite to the insertion direction by the slider member.

Patent Document 1: JP-A-2005-88575

The known liquid container realizes a reliable connection between the contact point of the circuit board and the contact point of the liquid consuming apparatus by forming the circuit board in the vicinity of the apparatus fixation structure. Specifically, when substantially rectangular flat liquid containers are arranged in a direction (hereinafter, referred to as "vertically positioned") in which a pair of flat largest surfaces are perpendicular to a vertical surface, the circuit board is disposed on a side surface and the apparatus fixation structure is disposed on a lower surface close to the side surface. That is, the circuit board and the container fixation structure are formed on two surfaces which are near the outer surface of the container and are perpendicular to each other.

Recently, however, as the number of the liquid containers increases in order to improve printing quality, the liquid containers have been configured so as to be arranged lengthwise with high density.

However, the circuit board and the container fixation structure are formed on the two right surfaces of the container which are perpendicular to each other. Accordingly, when the known liquid containers are lengthwise arranged, for example, in this structure, gaps are normally interposed between the adjacent liquid containers in order to dispose the apparatus fixation structure. For this reason, the containers cannot be arranged with the high density.

Alternatively, when the apparatus fixation structure is separately positioned, positioning precision of the contact point of the circuit board deteriorates. Accordingly, since the apparatus terminal and the contact point of the circuit board are easily separated, good electrical connection may not be obtained.

Recently, as a size of the liquid container increases, an urging force has a tendency to increase in a direction opposed to an insertion direction of a slider member of the apparatus fixation structure. Accordingly, when the container body is detached from or attached to the container mounting portion, the liquid main body may strongly rushes out from the container mounting portion.

SUMMARY

The invention is contrived in view of the above-described problems and an object of the invention is to provide a liquid container which enables the liquid containers to be accommodated with high density without deterioration of electrical connection between the contact point of the apparatus terminal and the circuit board, a container holder, and a liquid consuming apparatus.

According to an aspect of the invention, there is provided a liquid container that has a container body storing a liquid to be supplied to a liquid consuming apparatus and that is detachably mounted on a container mounting portion of the liquid consuming apparatus, wherein a liquid supply port for sending out the liquid to be supplied to the liquid consuming apparatus is formed on a front end surface in an insertion direction of the container body having a substantially rectangular shape, wherein a circuit board having a contact point with the liquid consuming apparatus is formed on one side surface perpendicular to one corresponding short side of the front end surface in the insertion direction, and wherein a container fixation structure for releasably regulating a movement of the container body in a direction opposite to the insertion direction thereof in cooperation with an apparatus fixation structure formed on the container mounting portion is formed on the other side surface perpendicular to the other corresponding short side of the front end surface in the insertion direction when the container body is mounted on the container mounting portion against an urging force in the direction opposite to the insertion direction.

According to another aspect of the invention, there is provided a liquid consuming apparatus including: a liquid ejecting head ejecting a liquid; a plurality of substantially rectangular liquid containers each storing the liquid supplied to the liquid ejecting head therein; and a plurality of container mounting portions mounted with the plurality of liquid containers. In the liquid consuming apparatus, the plurality of liquid containers each have a circuit board with at least one electrode, a container fixation structure, a substantially rectangular front end surface being a front end when each liquid container is mounted on the corresponding container mounting portion, a first side surface intersecting a first short side of a substantially rectangular shape, a second side surface intersecting a second short side of the substantially rectangular shape, and a liquid supply port disposed on the front end surface, an apparatus terminal coming in contact with a contact point of the electrode so as to be electrically connected to the electrode and an apparatus fixation structure are disposed on each container mounting portion, each liquid container is mounted on the corresponding container mounting portion so that one of the first and second side surfaces becomes a top surface and the other thereof becomes a bottom surface, the circuit board is disposed on the first side surface, the container fixation structure is disposed on the second side surface, the apparatus terminal is disposed above the circuit board when each liquid container is mounted so that the first side surface becomes the top surface and the apparatus terminal is disposed below the circuit board when each liquid container is mounted so that the first side surface becomes the bottom surface, and the apparatus fixation structure is disposed below the container fixation structure when each liquid container is mounted so that the second side surface becomes the bottom surface and the apparatus fixation structure is disposed above the container fixation structure when each liquid container is mounted so that the second side surface becomes the top surface.

According to the liquid container and the liquid consuming apparatus with such configurations, the substantially rectangular container main bodies are arranged in parallel in a direction (hereinafter, referred to as "arranged lengthwise") in which a pair of parallel largest surfaces are parallel to a vertical surface. In addition, the circuit board is formed on one of the top and bottom surfaces of each container body corresponding to a pair of the opposite short sides of the front end surface in the insertion direction, and the container fixation structure is formed on the other thereof.

Accordingly, it is not necessary to form the apparatus terminal and the apparatus fixation structure of the liquid consuming apparatus between the adjacent liquid containers. As a result, it is possible to accommodate the plurality of liquid containers closely. Even when the plurality of liquid containers are arranged, a total width size of the liquid containers in a thickness direction (short side direction of the front end surface) becomes small and compact. Moreover, since the circuit board and the apparatus fixation structure are formed on both parallel side surfaces, it is easier to realize the configuration in which the apparatus terminal and the contact point of the circuit board are closely formed. As a result, even when the plurality of liquid containers are arranged lengthwise, electrical connection between the apparatus terminal and the contact point of the circuit board does not deteriorate.

In the liquid container with the above-described configuration, the liquid container may have a rear end surface opposed to the front end surface, the circuit board and the container fixation structure may be formed at a position closer to the front end surface than the rear end surface, the one side surface may be disposed at a top surface and the other side surface is disposed at a bottom surface when the container body is mounted on the container mounting portion, and the container fixation structure may be pressed on the top surface by the apparatus fixation structure.

In the liquid consuming apparatus with the above-described configuration, the liquid container may have a rear end surface opposed to the front end surface. the circuit board and the container fixation structure may be disposed at a position closer to the front end surface than the rear end surface, the liquid container may be mounted on the mounting portion so that the first side surface becomes a top surface and the second side surface become a bottom surface, and the top surface of the apparatus fixation structure may press the container fixation structure With such a configuration, when the ink leaks from the liquid supply port, it is possible to prevent electrical connection failure of the circuit board due to the leaked ink. In particular, in order to maintain positioning precision between the liquid container and the container mounting portion, positioning mechanisms such as the positioning hole and the positioning pin fitted to each other can be used. At this time, the liquid supply port is disposed above the center portion of a liquid containing member (for example, an ink pack) accommodated in the liquid container in a height direction (vertical direction) by integrating the positioning mechanisms in addition to the circuit board and the liquid supply port on the top surface. In addition, in the center portion of the liquid containing member in the height direction (vertical direction), there can be provided a flow passage formed for allowing the liquid supply port and the liquid ejecting port to be connected to each other. A difference in the height between the liquid supply port and the liquid containing member or resistance of the flow passage reduce the ink leakage in a case where a static pressure of the liquid containing member is high due to the filled ink. That is, when the first and second side surfaces are arranged so as to be the top and bottom surfaces, respectively, it is easier to improve the positional precision and the like between the circuit board and the apparatus terminal and reduce the ink leakage in the case where the static pressure of the liquid containing member is high. The static pressure will be described in detail bellow.

In the liquid container with the above-described configuration, the contact point of the circuit board may be formed at a position closer to the front end surface in the insertion direction than a position at which a locking member of the apparatus fixation structure is locked to a locking portion of the container fixation structure.

In the liquid consuming apparatus with the above-described configuration, when the liquid container is mounted on the container mounting portion, the apparatus terminal may come in contact with the contact point at a position closer to the front end surface than a position at which a locking member of the apparatus fixation structure is locked to a locking portion of the container fixation structure.

According to the liquid container and the liquid consuming apparatus with such configurations, when the container body is inserted into the container mounting portion, the locking portion of the container fixation structure formed on another side surface of the container body is pressed by the locking member of the apparatus fixation structure. Accordingly, the front end surface of the container body in the insertion direction thereof rotates toward one side surface about the rear end surface in the insertion direction.

The contact point of the circuit board formed on one side surface of the container body is pushed to the apparatus terminal of the liquid consuming apparatus. However, since the contact point of the circuit board is formed closer to the front end surface in the insertion direction than the locking portion of the container fixation structure, the contact point can be moved closer to the apparatus terminal of the liquid consuming apparatus than the locking member of the apparatus fixation structure is moved to the locking portion of the container fixation structure. As a result, the contact point of the circuit board can be more reliably connected to the apparatus terminal.

In the liquid container with the above-described configuration, a concave portion may be formed on the other side surface perpendicular to the other corresponding short side of the front end surface in the insertion direction so as to be positioned more away from the frond end surface in the insertion direction than the container fixation structure. In the liquid consuming apparatus with the above-described configuration, a concave portion formed on the second side surface of the liquid container may be disposed at a position more away from the front end surface than the container fixation structure.

The concave portion can be used to achieve various objects, but may be particularly used as a jump prevention structure when the liquid container is detached.

That is, the concave portion may prevent the container body from jumping out of the container mounting portion in cooperation with an apparatus jump prevention structure formed on the container mounting portion. In addition, an apparatus jump prevention structure for preventing the liquid container from jumping out of the container mounting portion by engagement with the concave portion may be disposed in the container mounting portion.

According to the liquid container with such a configuration, it is possible to prevent the unexpected jumping of the liquid container from the container mounting portion.

In particular, using the concave portion as the jump prevention structure and forming the apparatus jump prevention structure on the container mounting portion effectively facilitates detachment of the liquid container mounted on the container mounting portion in a state where the liquid container is urged in the direction opposite to the insertion direction of the liquid container. In this case, the liquid container may be detached at a predetermined speed by the urging force and may rushes out. However, the movement of the liquid container is regulated by engagement of the apparatus jump prevention structure with the concave portion. As a result, it is possible to reliably the rushed liquid container from coming off from the container mounting portion.

In the liquid container with the above-described configuration, a chamfered surface on which a notch may be formed in the insertion direction is disposed on a corner portion corresponding to a side perpendicular to the front end surface in the insertion direction.

In the liquid consuming apparatus with the above-described configuration, the liquid container may have a third side surface intersecting the first long side of the substantially rectangular shape and a fourth side surface intersecting a second long side of the substantially rectangular shape, a chamfered surface may be formed in the insertion direction at a corner portion corresponding to a side at which two of the first to fourth side surfaces intersect each other, and a guide protrusion corresponding to a shape of a notch of the corner portion at which the chamfered surface is formed may be disposed on the container mounting portion in the insertion direction of the liquid container.

According to the liquid container and the liquid consuming apparatus with such configurations, when the substantially rectangular flat liquid containers are lengthwise arranged in parallel, end triangular spaces formed by the chamfered surface of one liquid container between the adjacent liquid containers are formed in the insertion direction. The end triangular spaces can be used as a position at which the guide protrusion is mounted. As a result, it is possible to miniaturize gaps between the adjacent container main bodies and to mount the plurality of liquid containers with high density.

In the liquid container with the above-described configuration, the container fixation structure may include a guide groove into which a locking member of the apparatus fixation structure is inserted and which guides the locking member to a lock position or a non-lock position when the container body is attached to or detached from the container mounting portion.

In the liquid consuming apparatus with the above-described configuration, the container fixation structure may have a guide groove and a locking portion, the apparatus fixation structure may have a locking member, and the locking member may be inserted and guided to the guide groove of the container fixation structure when the liquid container is attached to or detached from the container mounting portion and the locking member is locked to the locking portion of the container fixation structure when the liquid container is mounted on the container mounting portion.

According to the liquid container and the liquid consuming apparatus with such configurations, the liquid container can be reliably and precisely fixed to the container mounting portion. In particular, when the locking member is configured to be relatively moved by pushing the locked container body to the container mounting portion, burden on a user in an attaching or detaching operation of the liquid container or load applied to the liquid container or the liquid consuming apparatus can be reduced.

In the liquid container with the above-described configuration, a bottom surface of the guide groove may be pressed by the locking member.

In the liquid consuming apparatus with the above-described configuration, the locking member may be formed in a direction intersecting the second side surface and is urged so as to press the bottom surface of the guide groove.

According to the liquid container and the liquid consuming apparatus with such configurations, one side surface of the liquid container is urged toward the other side surface of another liquid container by the locking member. Accordingly, since the contact point of the circuit board formed on one side surface of the liquid container is configured to be pushed to the apparatus terminal by the locking member, the contact point of the circuit board and the apparatus terminal are more reliably connected to each other.

In the liquid container with the above-described configuration, the front end surface in the insertion direction of the container body may include a pair of positioning holes which are spaced from each other on the front end surface in the insertion direction and which regulate a movement of the container body in a direction along the front end surface in the insertion direction by fitting a pair of positioning pins formed on a surface of the container mounting portion opposed to the front end surface in the insertion direction.

In the liquid consuming apparatus with the above-described configuration, a pair of positioning holes may be formed in the front end surface of the liquid container, a pair of positioning pins which are fitted in the pair of positioning holes may be formed on the container mounting portion, and a movement of the liquid container in a direction along the front end surface in the insertion direction of the liquid container may be regulated by fitting the pair of positioning pins into the pair of positioning holes.

According to the liquid container and the liquid consuming apparatus with such configurations, when the liquid container is mounted on the container mounting portion, the pair of positioning pin formed on the container mounting portion is fitted to the pair of the positioning hole formed on the front end surface of the liquid container. Afterward, as the liquid container is further inserted, the liquid container is moved on the basis of the positioning pin. When the liquid container is completely mounted, the direction along the front end surface of the liquid container is determined by fitting the positioning hole to the positioning pin, and a movement of the liquid container in the direction along the front end surface in the insertion direction is regulated. That is, since the liquid container is mounted on the container mounting portion at an exact inclination, it is easier to mount the liquid container. Moreover, it is possible to prevent the circuit board, the apparatus terminal, the container fixation structure, or the apparatus fixation structure from being broken by attaching or detaching liquid container at erroneous inclination. Moreover, when the liquid container is mounted, it is possible to maintain good electrical connection between the circuit board and the apparatus terminal or maintain good fixation between the container fixation structure and the apparatus fixation structure.

In the liquid container with the above-described configuration, the pair of positioning holes on the front end surface in the insertion direction and the circuit board and the container fixation structure on both surfaces perpendicular to the opposite short sides of the front end surface in the insertion direction may be disposed substantially on the same vertical cross section of the container body.

In the liquid consuming apparatus with the above-described configuration, the pair of positioning holes, the circuit board, and the container fixation structure of the liquid container may be formed on the substantially same vertical cross section.

According to the liquid container and the liquid consuming apparatus with such configurations, when the liquid container is mounted on the container mounting portion and the pair of positioning pins formed on the container mounting portion are fitted in the pair of positioning holes formed on the front end surface of the liquid container, the liquid container is positioned in the direction (that is, the direction parallel to vertical cross section) along the front end surface, and the contact point of the circuit board and the apparatus terminal formed on one side of the vertical cross section and the fixation structures formed on the other of the vertical cross section are positioned in an approach direction or a separation direction.

In the liquid consuming apparatus with the above-described configuration, the plurality of container mounting portions may be arranged in parallel so that the third side surface of one of two adjacent liquid containers is opposed to the fourth side surface of the other thereof.

In this way, the total width size for accommodating the liquid containers in the thickness direction can be smaller and compact by arranging the side surfaces of the plurality of liquid containers so as to be opposed to each other without formation of a wall for partitioning the liquid containers.

According to still another aspect of the invention, there is provided a container holder of a liquid consuming apparatus comprising a plurality of container mounting portions mounted with the liquid container with the above-described configuration, wherein a guide protrusion corresponding to the shape of the notch on the corner portion on which the chamfered surface is formed is disposed on each of the container mounting portions in the insertion direction of the container body.

According to the container holder with such a configuration, it is possible to miniaturize the gaps between the adjacent container main bodies and to accommodate the plurality of liquid containers with high density.

In the container holder with the above-described configuration, the container mounting portions may be arranged in parallel so that side surfaces perpendicular to corresponding long sides of the front end surfaces in the insertion direction of the container body are opposed to each other among the adjacent container main bodies.

In this way, the total width size for accommodating the liquid containers in the thickness direction of the liquid containers can be smaller and compact by arranging the side surfaces of the plurality of liquid containers so as to be opposed to each other without formation of a wall for partitioning the liquid containers. As a result, it is possible to form the container holder with the compact and small width size in the thickness direction of the liquid containers.

BRIEF DESCRIPTION OF THE DRAWINGS

The invention will be described with reference to the accompanying drawings, wherein like numbers reference like elements.

FIG. 4(*b*) is a perspective view illustrating the apparatus fixation structure 50 when viewed from a side opposite the ink cartridges 100.

FIG. 4(*c*) is a sectional view illustrating the vicinity of the apparatus fixation structure 50.

FIG. 16(*b*) is a perspective view illustrating each ink cartridge 100 when viewed from an arrow D shown in FIG. 16(*a*).

DESCRIPTION OF EXEMPLARY EMBODIMENTS

Hereinafter, a liquid container, a container holder, and a liquid consuming apparatus according to an embodiment of the invention will be described with reference to the accompanying drawings.

Figure 1:
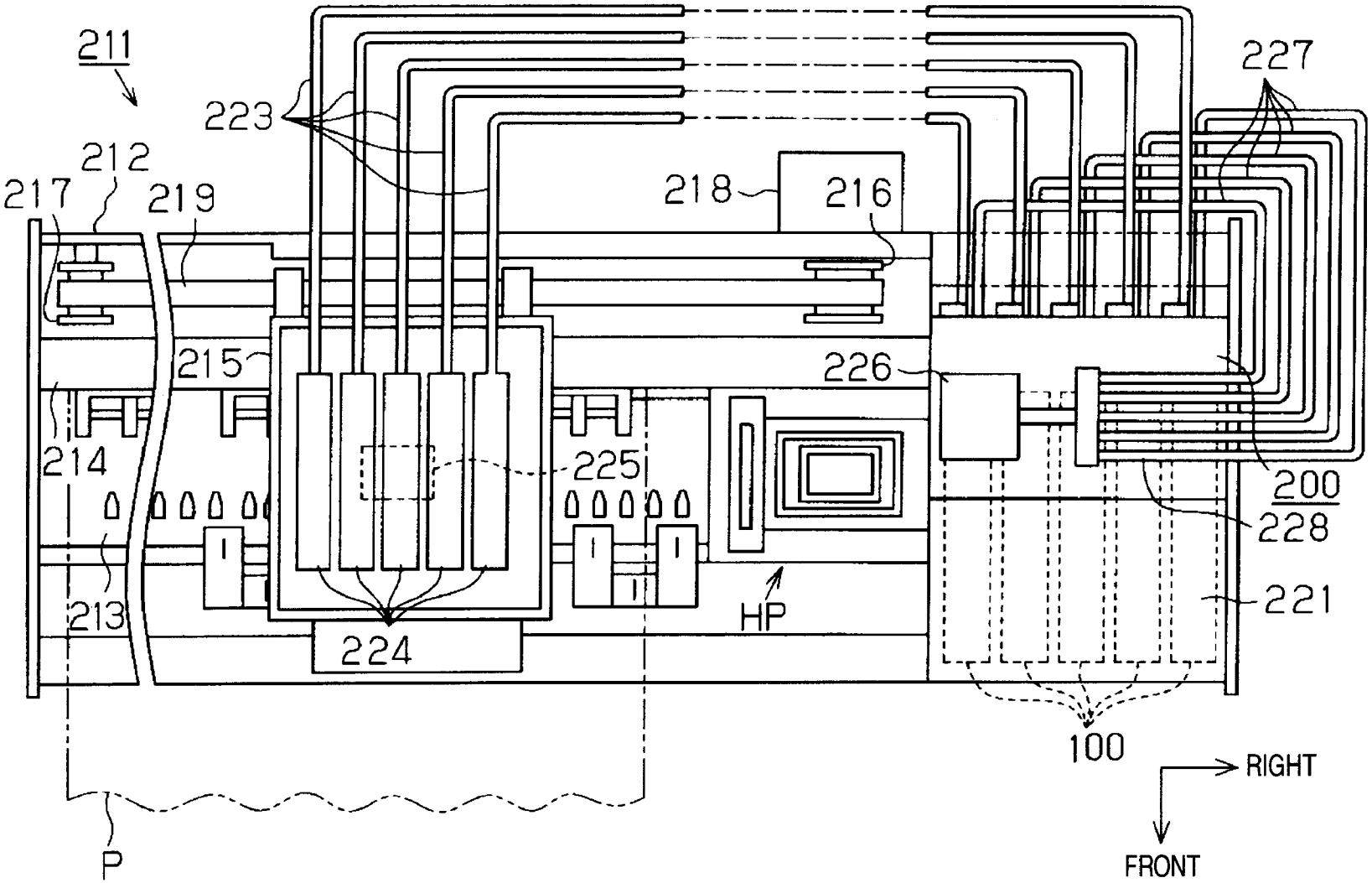
FIG. 1 is a schematic diagram illustrating a configuration of a liquid consuming apparatus according to an embodiment of the invention.

FIG. 1 is a schematic diagram illustrating a configuration of a liquid consuming apparatus according to an embodiment of the invention. As shown in FIG. 1, an ink jet printing apparatus 211, which is a liquid consuming apparatus according to this embodiment, includes a main body case 212 with a substantially rectangular box-like shape. In a front lower portion of the inside of the main body case 212, a platen 213 is disposed in a length direction (right and left directions in FIG. 1) of the main body case 212, which is a primary scanning direction. The platen 213 is a support board for supporting a print sheet P to be printed. On the platen 213, the print sheet P is configured to be transported along a secondary scanning direction perpendicular to the primary scanning direction by a paper-feeding mechanism (not shown).

In a rear upper portion of the platen 213 in the main body case 212, a guide shaft 214 with a bar shape is disposed along the primary scanning direction. A carriage 215 is supported by the guide shaft 214 to move along the guide shaft 214.

In a rear side surface of the inside of the main body case 212, a driving pulley 216 and a driven pulley 217 are rotatably supported at positions corresponding to both end portions of the guide shaft 214. A carriage motor 218 is connected to the driving pulley 216 and an endless timing belt 219 for supporting the carriage 215 is suspended between the pair of driving pulley 216 and the driven pulley 217. Accordingly, the carriage 215 is configured to reciprocate along the guide shaft 214 in the primary scanning direction by drive of the carriage motor 218.

A cartridge holder 200, which is a container holder with a box-like shape, is disposed in one end (right end in FIG. 1) of the inside of the main body case 212. In the cartridge holder 200, portions corresponding to front portions of a front wall and an upper wall are configured as a cover portion 221 which can be opened or closed. A user can attach or detach an ink cartridge 100, which is a liquid container, to exchange it by opening the cover portion 221. That is, in a state where the cover portion 221 is opened, a plurality of the ink cartridges 100 (5 cartridges according to this embodiment) prepared for colors of ink, which are liquids, are configured to be attached to or detached from the cartridge holder 200 when inserted or removed in front and rear directions.

Each ink cartridge 100 is configured to be connected to an upstream end of corresponding ink supply passage 223 when mounted on the cartridge holder 200. In addition, a downstream end of each ink supply passage 223 is connected to the upstream side of a corresponding valve unit 224 mounted on the carriage 215. Downstream sides of the valve units 224 are configured to be connected to a print head 225, which is a liquid ejecting head, disposed in the lower surface of the carriage 215.

A home position HP which is an evacuation position of the print head 225 is disposed between the cartridge holder 200 and the platen 213. In addition, before a printing operation starts and the like, the print head 225 is in the home position HP and various maintenance operations such as a cleaning of the print head 225 are performed.

In the inside of the main body case 212, a pressurizing pump 226 is disposed in an upper side of the cartridge holder 200. The pressurizing pump 226, which is a supply source of pressurizing air, is connected to the upstream end of pressurization air supply passages 227. The number of the pressurization air supply passages 227 distributed from distributors 228 disposed on the downstream side of the pressurizing pump 226 is the same as that of the ink cartridges 100. The downstream end of each distributed pressurization air supply passage 227 is connected to the corresponding ink cartridge 100.

Figure 2:
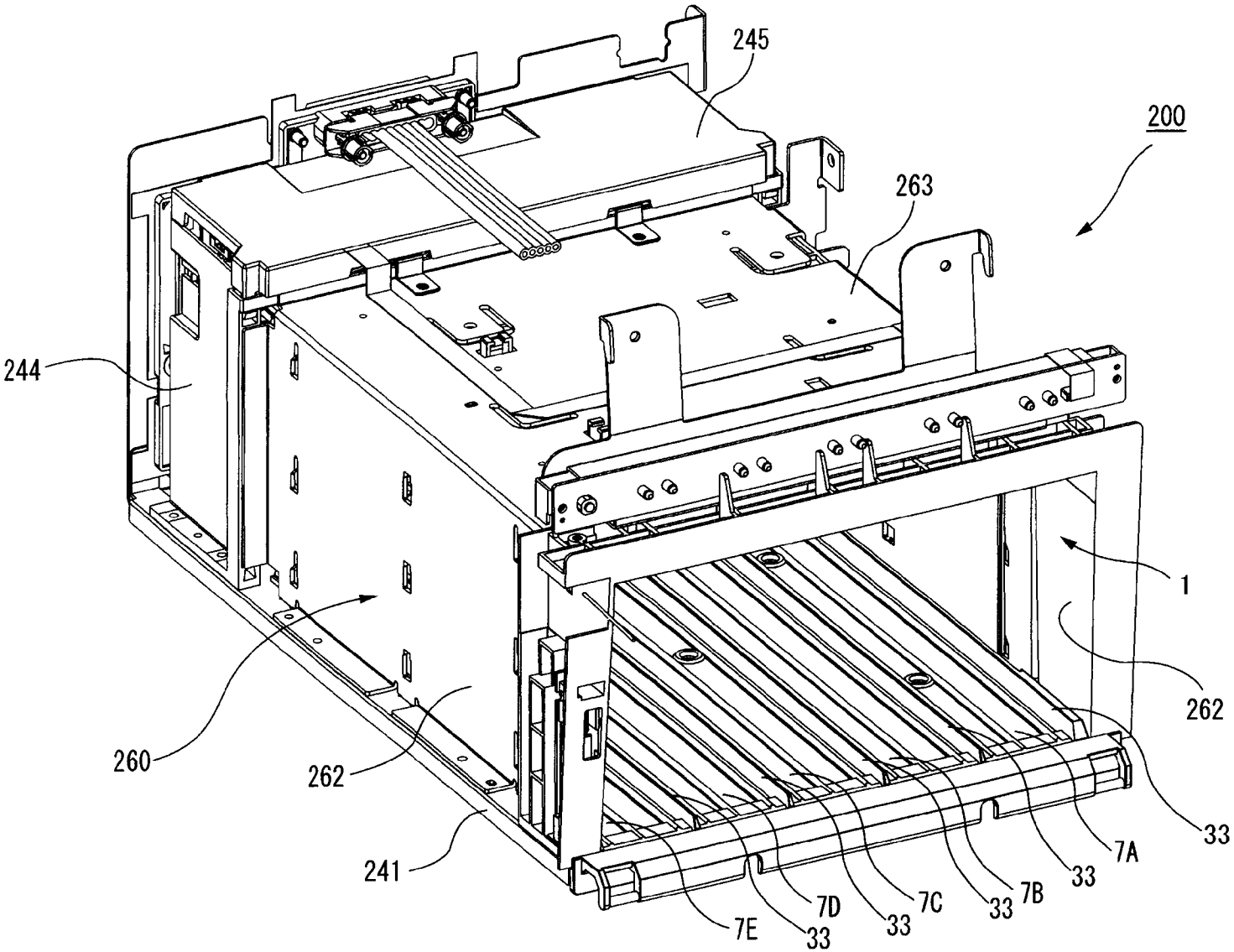
FIG. 2 is a perspective view illustrating the cartridge holder 200 when obliquely viewed from the upside.

FIG. 2 is a perspective view illustrating the cartridge holder 200 mounted with the liquid containers 100 when obliquely viewed from the upside.

As shown in FIG. 2, the cartridge holder 200 includes a holder main body 240 with a substantial L shape in a side view and a frame body 260 of the end surface with a ⊃ shape.

The frame body 260 includes a pair of sidewalls 262 and a top wall 263 connecting the upper ends of the sidewalls 262. The frame body 260 is formed of a metal plate by a press forming.

Figure 3:
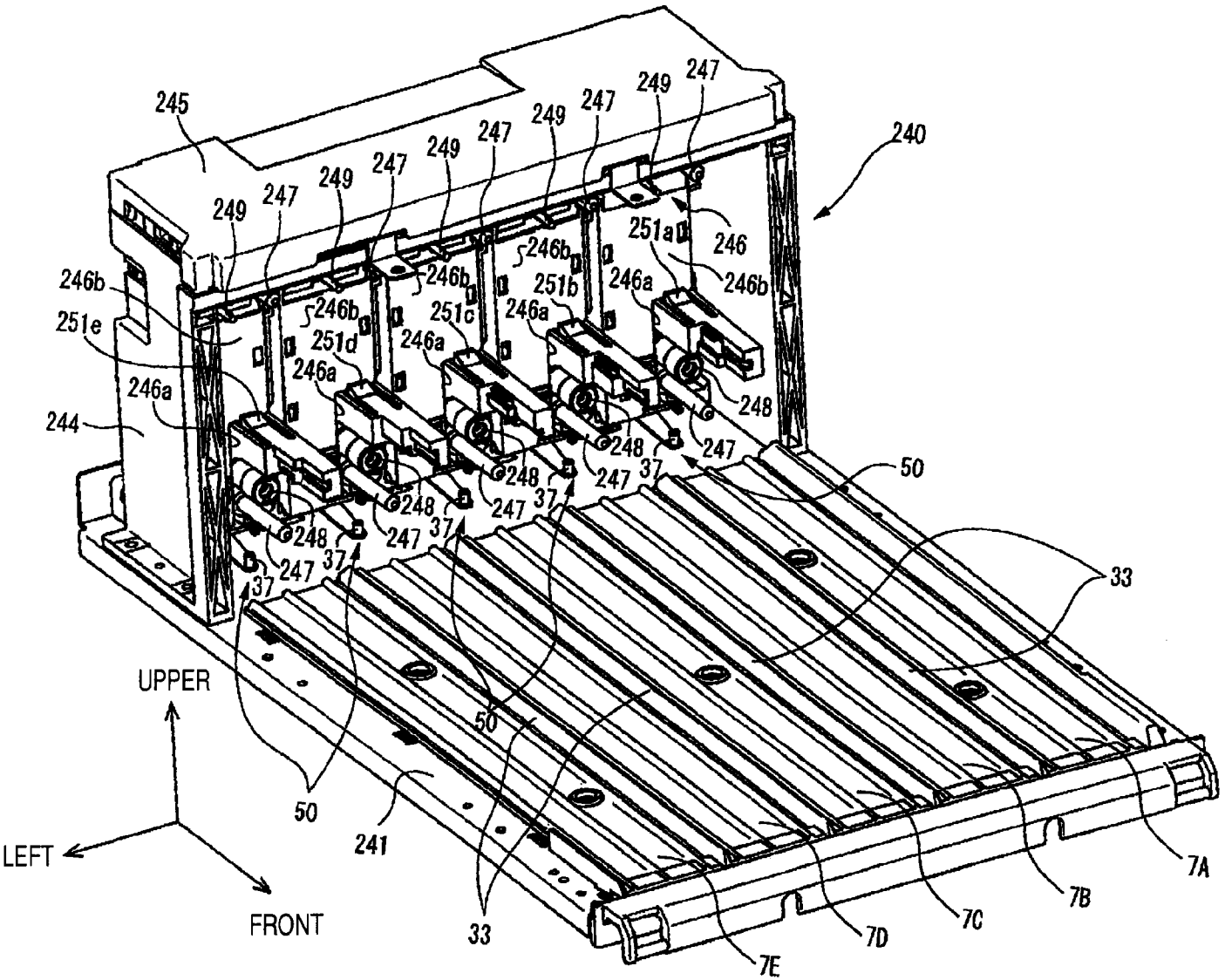
FIG. 3 is a perspective view illustrating the holder main body 240 and a perspective view illustrating the cartridge holder 200 mounted with ink cartridges 100.

FIG. 3 is a perspective view illustrating the holder main body 240 constituting a part of the cartridge holder 200 when obliquely viewed from the upside. As shown in FIG. 3, a holder main body 240 includes a board 241, which is made of a resin material or a metal material and has a substantially rectangular shape in a top view, and a wall body 244 mounted on the rear upper surface of the board 241.

The board 241 is a support board for placing the ink cartridges 100 in parallel when the ink cartridges 100 are mounted on the cartridge holder 200. On the board 241, a plurality of guide rails (guide protrusions) 33 are disposed so as to extend along front and rear directions.

The guide rails 33 are formed to guide the ink cartridges 100 when the ink cartridges 100 are attached to or detached from the cartridge holder 200. In the inside of the cartridge holder 200, the guide rails 33 partition five cartridge slots 7A to 7E. The cartridge slots 7A to 7E serve as a container mounting portion for separately accommodating each ink cartridge 100 of each color.

The wall body 244 is formed in a ⊃ shape in a top view. The wall body 244 is attached to the board 241 so as to be directed toward a passage frontward. A top plate 245 formed in a rectangular shape is mounted on the upper end of the wall body 244.

The wall body 244 includes a rear surface (not shown). In addition, the wall body 244 includes a slider member 246 having surfaces 246*b* substantially parallel to the rear surface of the wall body 244.

The slider member 246 is configured to be urged frontward, that is, in a direction opposite to an insertion direction of the ink cartridge 100 by urging means (not shown). The surfaces 246*b* of the slider member 246 form an inward end surface of the cartridge slots 7A to 7E. When the ink cartridges 100 are not mounted on the cartridge slots 7A to 7E, the slider member 246 is positioned on a front side by a force of the urging means.

When the ink cartridges 100 are inserted into the cartridge slots 7*a* to 7E, the slider member 246 is pushed by the front end surfaces 11 (see FIGS. 8 to 10) of the ink cartridges 100 and is moved rearward.

When the ink cartridges 100 are completely mounted on the cartridge slots 7A to 7E, the slider member 246 is stopped at a predetermined position. Even when the ink cartridges 100 are mounted on the cartridge slots 7A to 7E, the force of the urging means allows the slider member 246 to normally apply an urging force to the mounted ink cartridges 100 in the direction opposite to the insertion direction. When the ink cartridges 100 are detached from the cartridge slots 7A to 7E, the urging force acts on the ink cartridges 100 to be pushed frontward.

In the slider member 246, opening portions 246*a* for exposing each pair of positioning pins 247 disposed on the rear surface of the wall body 244, air communicating ports 248, ink supply pins 249, and identification members 251*a* to 251*e* frontward from the rear surface of the wall body 244 are formed.

On the rear surface of the wall body 244, that is, on the inward end surface of the respective cartridge slots 7A to 7E, each pair of positioning pins 247, the air communicating ports 248, the ink supply pins 249, and the identification member 251*a* to 251*e* are formed so as to be protrude frontward through the opening portions 246*a* of the slider member 246.

Each pair of positioning pins 247, the air communicating ports 248, the ink supply pins 249, and the identification member 251*a* to 251*e* function when the ink cartridges 100 are mounted on the cartridge slots 7A to 7E.

The pair of positioning pins 247 are used to position each ink cartridge 100. The pair of positioning pins 247 are formed on the upper portion and the lower portion of the inward end surface of the cartridge slots 7A to 7E.

The air communicating ports 248 supply air to each ink cartridge 100. The air communicating port 248 is formed on the lower portion of the inward end surface of the cartridge slots 7A to 7E. In addition, the air communicating port 248 is formed at a position between the pair of positioning pins 247 and at a position closer to the positioning pin 247 in the lower portion.

The ink supply pin 249 is used to supply the ink from each ink cartridge 100 to the print head 225 (see FIG. 1) through the corresponding ink supply passage 223 (see FIG. 1). The ink supply pin 249 is formed on the upper portion of the inward end surface of the cartridge slots 7A to 7E. In addition, each ink supply pin 249 is formed at a position which is not between the pair of positioning pins 247 and a position closer to the positioning pin 247 in the upper portion.

The identification members 251*a* to 251*e* prevent the ink cartridges 100 from being erroneously mounted. The identification members 251*a* to 251*e* are formed on the lower portion of the inward end surface of the cartridge slots 7A to 7E, respectively. In addition, the identification members 251*a* to 251*e* are formed at the position between the pair of positioning pins 247 and a position right above the air communicating ports 248. That is, the identification members 251*a* to 251*e* are formed at the position between the upper positioning pin 247 and the air communicating port 248 and a position closer to the air communicating port 248.

The identification members 251*a* to 251*e* each have a hollow-hole cylindrical shape of which the rear end surface, which is a base end, are opened and which extend in front and rear directions. An uneven fitting portion is formed in the front end of each of the identification member 251*a* to 251*e*. In addition, an identification portion 22 (see FIG. 8) corresponding to the shape of the uneven fitting portion of each of the identification member 251*a* to 251*e* is formed on the front end surface in the insertion direction of the ink cartridge 100. The shape of the identification portion 22, as the detailed shape is omitted, depends on a type of the ink cartridge 100.

Each of the uneven fitting portions of the identification members 251*a* to 251*e* can be fitted only to the identification portion 22 of the corresponding ink cartridge 100, but not to be fitted to the identification portions 22 of the other types of the ink cartridges 100. In this way, the ink jet printing apparatus according to this embodiment is configured to prevent the ink cartridges 100 from being erroneously mounted by combination of the identification portions 22 of the ink cartridges 100 and the uneven fitting portions of the identification members 251*a* to 251*e*.

Figure 4:
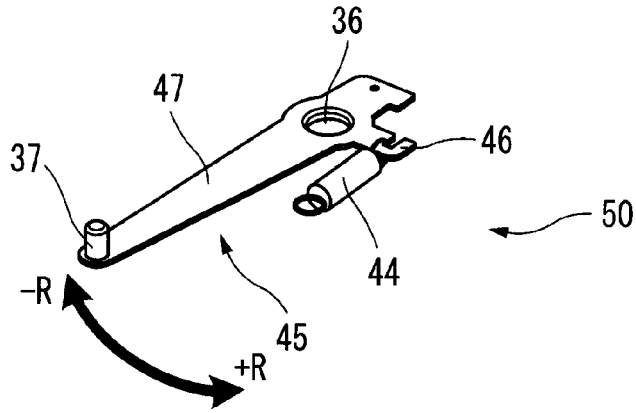
FIG. 4(*a*) is a perspective view illustrating a lever member 45 and a spring 44 when viewed from the side of the ink cartridges 100.
Figure 4:
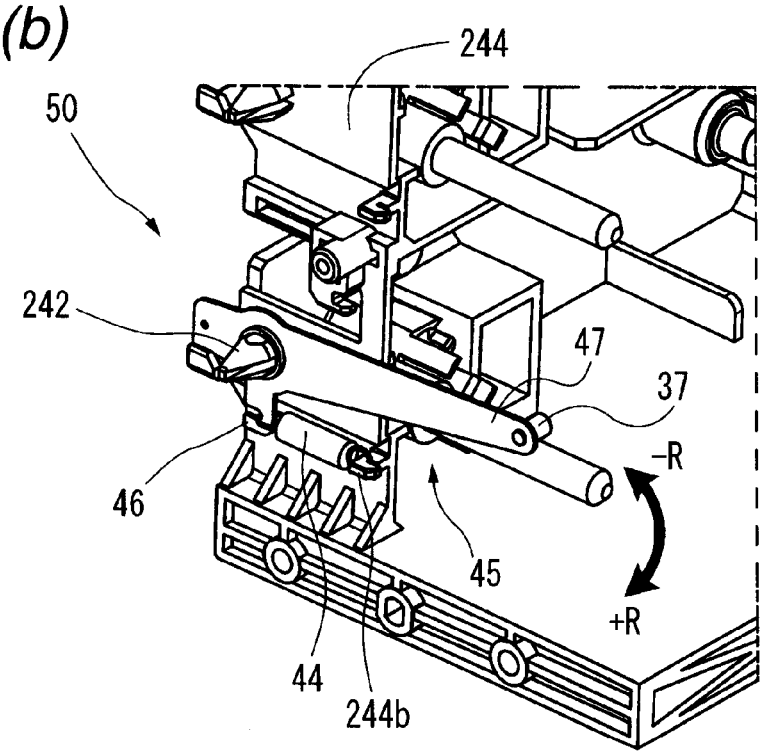
Figure 4:
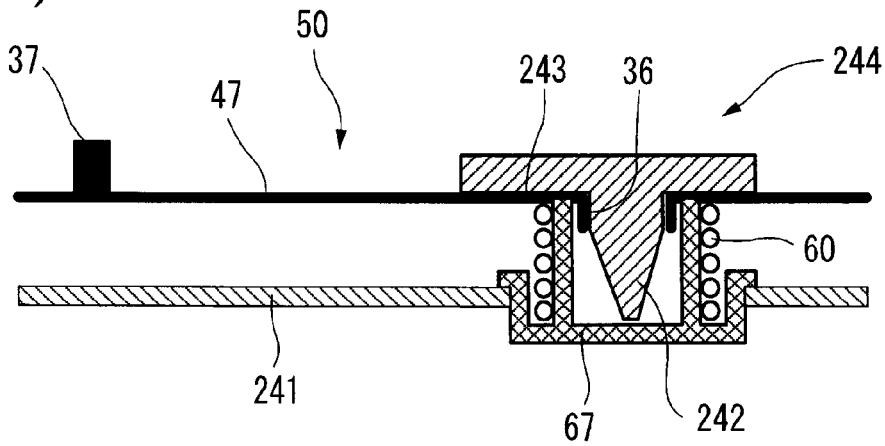

The apparatus fixation structure 50 is formed on the lower side and inward side (rear side) of the cartridge slots 7A to 7E. FIG. 4(*a*) is a perspective view illustrating a lever member 45 and a spring 44 constituting the apparatus fixation structure 50 when viewed from the side of the ink cartridges 100. FIG. 4(*b*) is a perspective view illustrating the apparatus fixation structure 50 when viewed from a side opposite the ink cartridges 100. FIG. 4(*c*) is a sectional view illustrating the vicinity of the apparatus fixation structure 50.

As shown in FIG. 4(C), the apparatus fixation structure 50 has the lever member 45 extending substantially in parallel to the board 241, that is, the lower portion of the cartridge slots 7A to 7E (see FIG. 3). The lever member 45 has a slim long lever main body 47 with elasticity, a shaft hole 36 formed in a base end portion, and a substantial cylindrical locking pin 37 protruding on the upper surface (which is a surface on the side of the ink cartridge 100) of the front end portion of the lever main body 47. There is a gap between a bottom surface 243 and board 241 of the wall body 244 and the lever member 45 is arranged by using the gap.

A protruding portion 242 is provided on the bottom surface 243 of the wall body 244. The shaft hole 36 of the lever member 45 is inserted into the protruding portion 242. The lever member 45 is axially supported so as to be rotatable about the protruding portion 242. That is, the protruding portion 242 functions as a rotation shaft of the lever member 45. The circumference of the protruding portion 242 is supported by a cap 38 and coil springs 60 accommodated in the groove of the cap 38. The coil springs 60 have a function of rotatably supporting the lever member 45 on the board 241 and a function of stabilizing the movement of the lever member 45 by urging the lever member 45 upward.

As shown in FIGS. 4(*a*) and 4(*b*), the apparatus fixation structure 50 has the spring 44 for applying an urging force in a rotation direction (−R direction) to the lever member 47. One end of the spring 44 is locked to the locking portion 46 formed at a position inclined in a direction different from a direction facing from the shaft hole 36 of the lever member 47 toward the locking portion 37. The other end of the spring 44 is locked to the locking portion 244*b* formed on the lower surface of the wall body 244. When a force against the urging force of the spring 44 is applied to the lever member 45, the lever member 45 rotates in an arrow +R direction shown in FIGS. 4(*a*) and 4(*b*).

Figure 5:
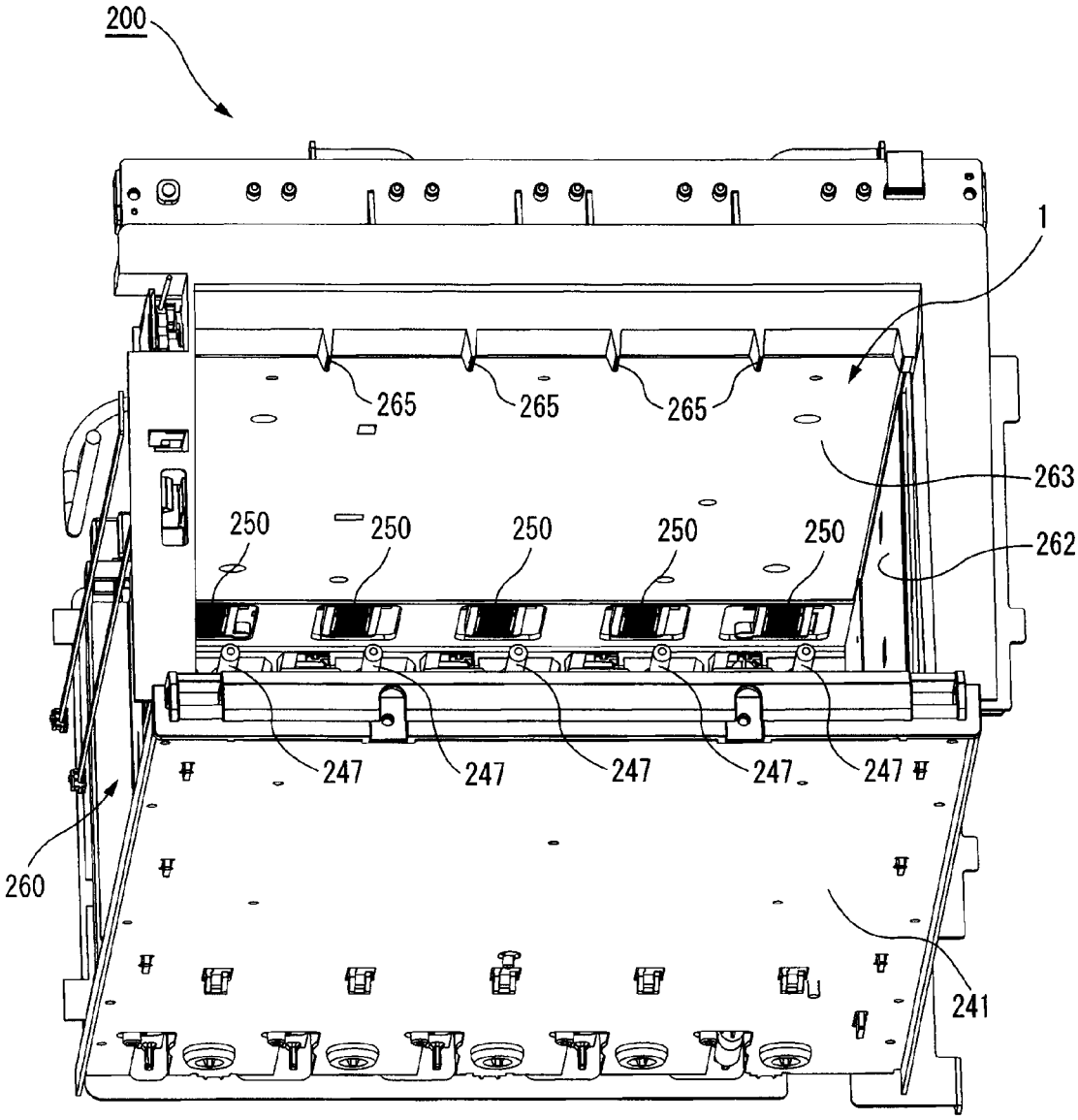
FIG. 5 is a perspective view illustrating the cartridge holder 200 when obliquely viewed from the downside.

FIG. 5 is a perspective view illustrating the cartridge holder 200 shown in FIG. 2 when obliquely viewed from the downside. Guide protrusions 265 with a triangular shape in a sectional view are formed on a surface opposite the top plate 245 of the wall body 244, that is, the top surface of the ink cartridges 7A to 7E. In addition, apparatus terminals 250 are formed on the inward side.

Like the guide rails 33, the guide protrusions 265 are used to guide the ink cartridges 100 when the ink cartridges 100 are attached to or detached from the cartridge slots 7A to 7E of the cartridge holder 200. When the ink cartridges 100 are attached or detached, the bottom surfaces of the ink cartridges 100 are guided to be positioned by the guide rails 33, but also the top surface of the ink cartridges 100 are also guided to be positioned by the guide protrusions 265. As a result, it is easier to attach or detach the ink cartridges 100.

The apparatus terminals 250 come in contact with the contact points 17*a* (see FIG. 8) of the electrodes of the circuit board 17 (see FIG. 8) formed in the ink cartridges 100 so as to be electrically connected to the electrodes when the ink cartridges 100 are mounted on the cartridge slots 7A to 7E.

Figure 6:
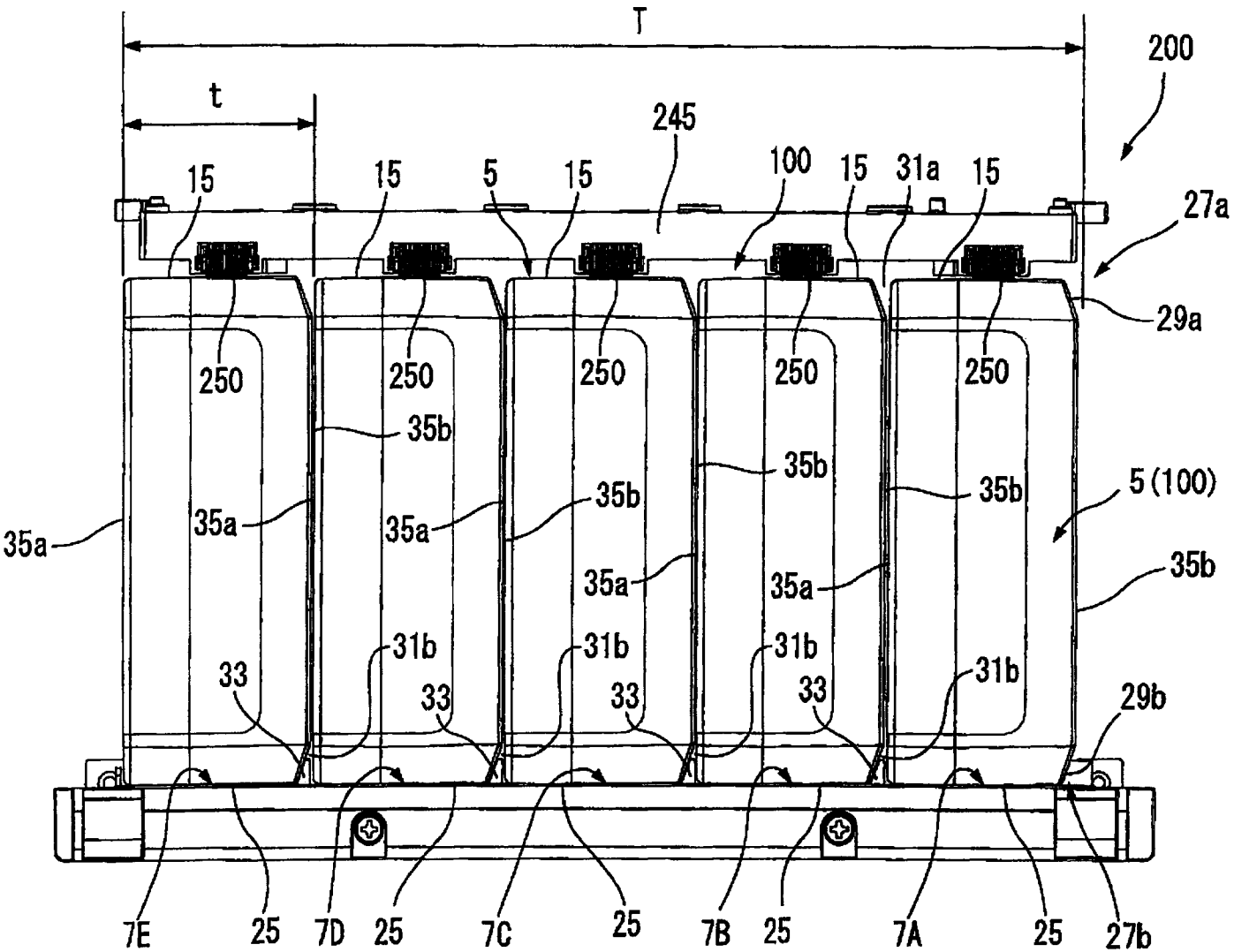
FIG. 6 is a front view illustrating the container holder 200 mounted with the liquid containers 100.
Figure 7:
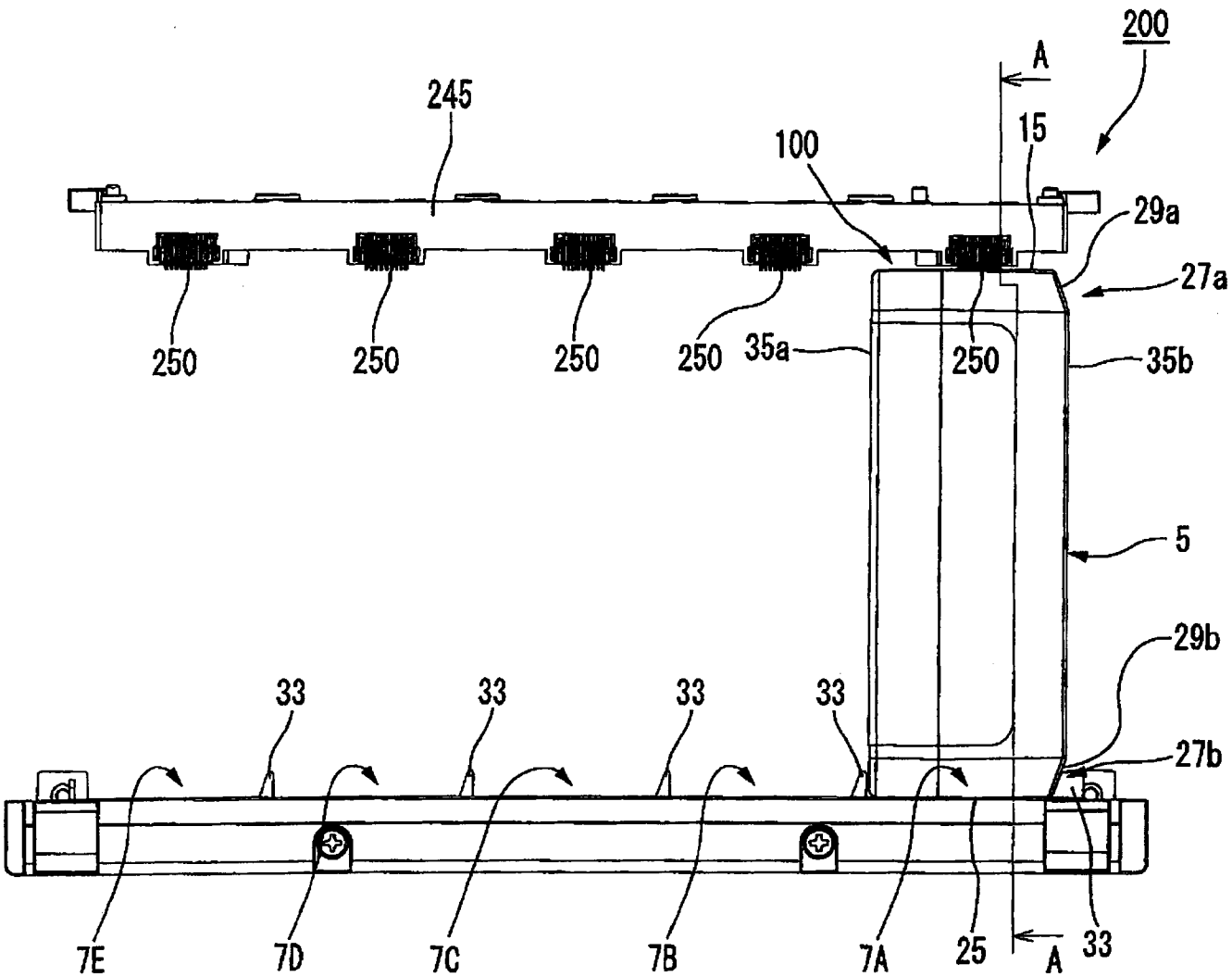
FIG. 7 is a front view illustrating the container holder 200 from which some liquid containers 100 are detached.

FIG. 6 is a front view illustrating the container holder 200 mounted with the liquid containers 100. FIG. 7 is a front view illustrating the container holder 200 from which some liquid containers 100 are detached. As shown in FIGS. 6 and 7, the ink cartridges 100 according to this embodiment are detachably mounted on the cartridge slots 7A to 7E of the cartridge holder 200 of the available ink jet printing apparatus, which is the liquid consuming apparatus, to supply the ink to the print head 255 (see FIG. 1) of the ink jet printing apparatus.

Figure 8:
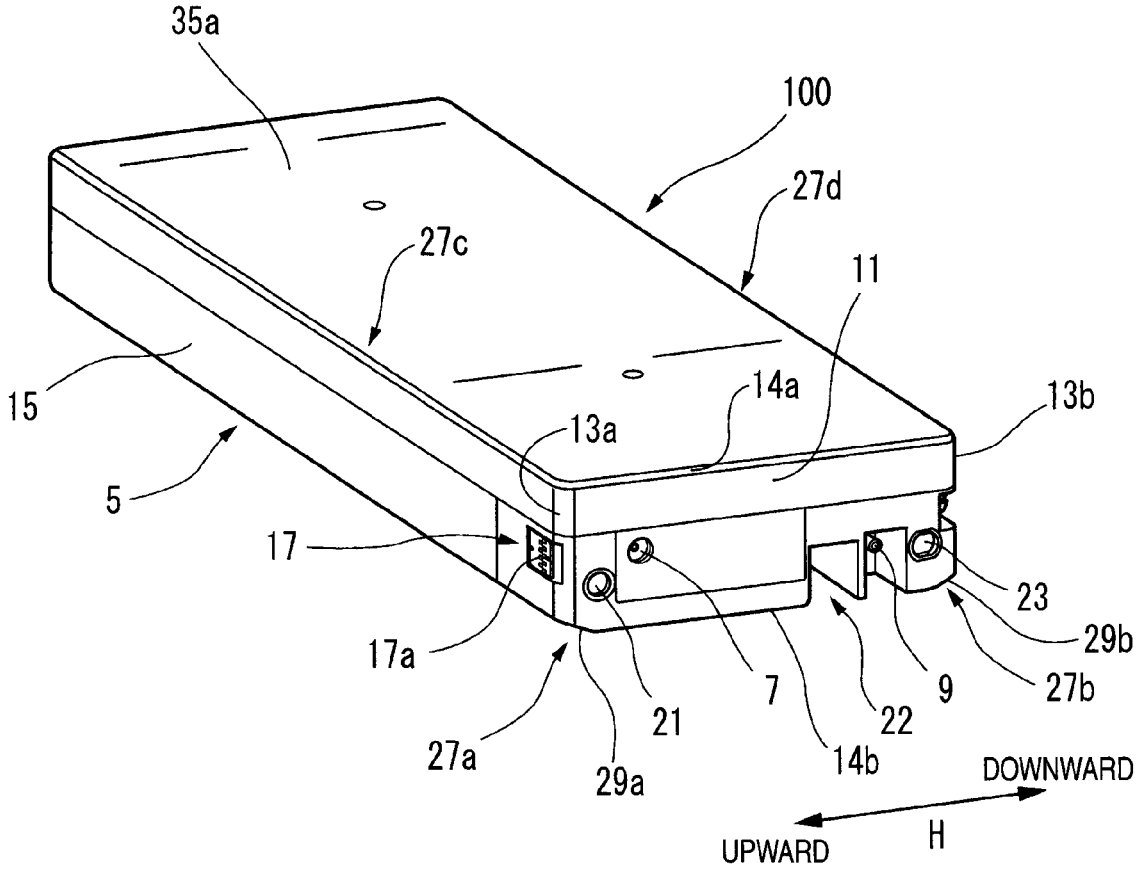
FIG. 8 is a perspective view illustrating the liquid container 100 when viewed from one side.
Figure 9:
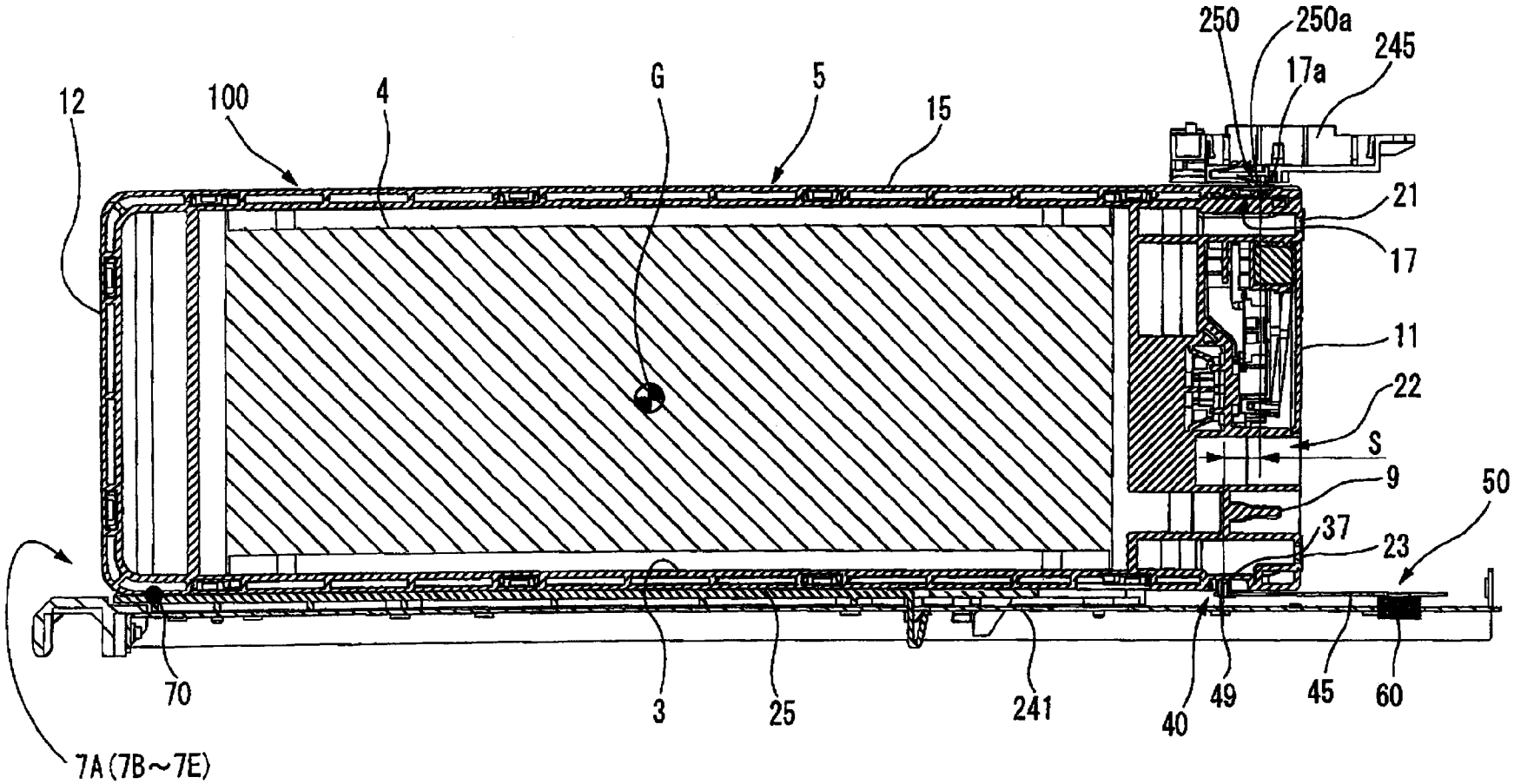
FIG. 9 is a perspective view illustrating the liquid container 100 taken along the line A-A shown in FIG. 7.
Figure 10:
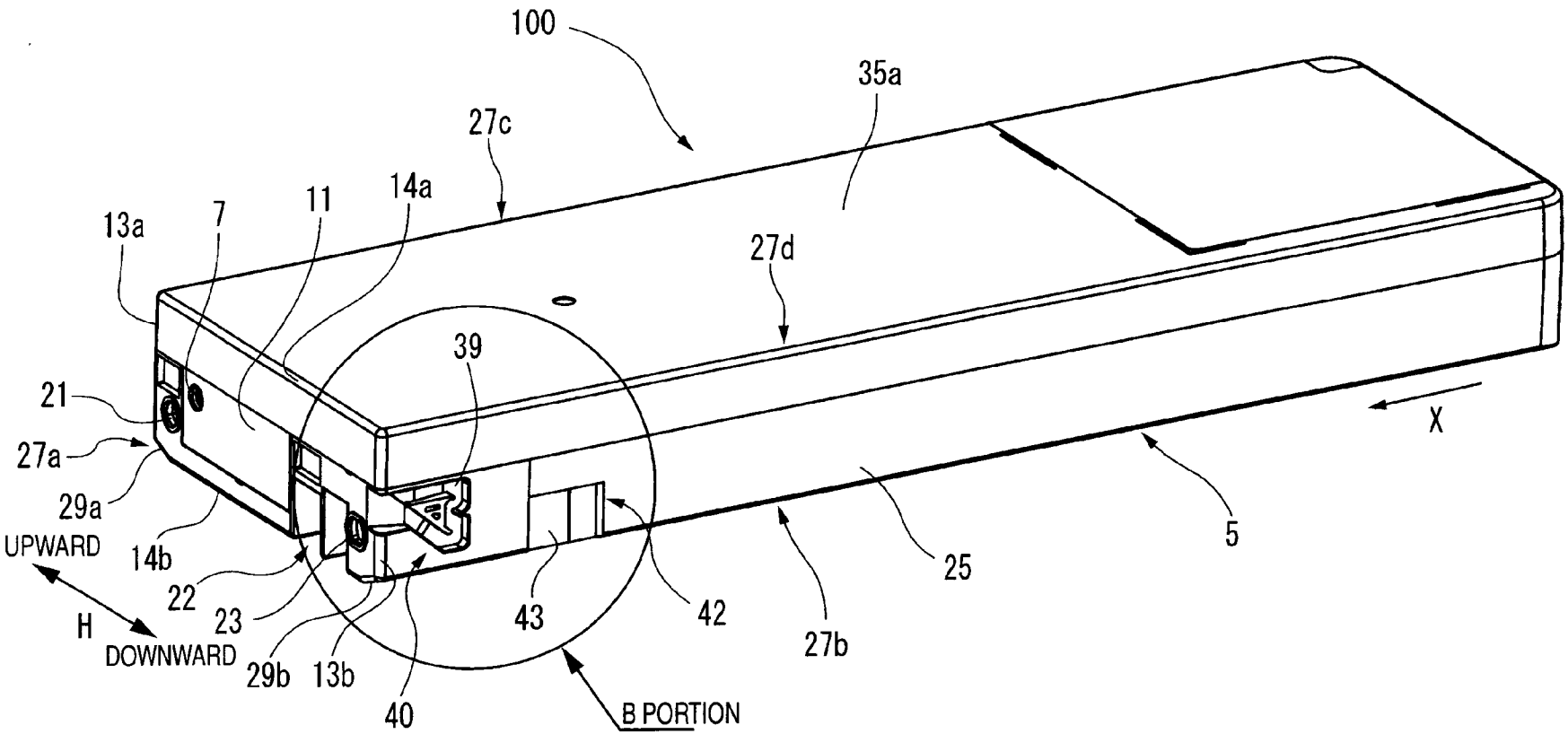
FIG. 10 is a perspective view illustrating the liquid container 100 when viewed from another side.

FIG. 8 is a perspective view illustrating the liquid container 100 when viewed from one side. FIG. 9 is a diagram illustrating the liquid container 100 taken along the line A-A shown in FIG. 7. FIG. 10 is a perspective view illustrating the liquid container 100 when viewed from another side.

The ink cartridge 100 includes a case 5 with a substantially rectangular flat shape as shown in FIG. 8. As shown in FIG. 9, a bag accommodating portion 3 is formed in the inside of the case 5. An ink pack 4 is accommodated in the bag accommodating portion 3.

In this embodiment, there are provided five types of the ink cartridges 100. Different five-color ink is stored in the ink packs 4 of the five types of ink cartridges 100. The five types of ink cartridges 100 have the same configuration except for the ink types stored in the ink packs 4 and the detailed shape of the identification portions 22 described above.

As shown in FIGS. 8 and 9, each ink cartridge 100 includes a substantially rectangular front end surface 11 and a rear end surface 12 opposite the front end surface 11. When the ink cartridges 100 are mounted on the cartridge slots 7A to 7E, each front end surface 11 and each rear end surface 12 become a front end and a rear end in the insertion direction, respectively.

As shown in FIGS. 6 to 10, each ink cartridge 100 has a first side surface 15 intersecting a first short side 13*a* of the substantially rectangular front end surface 11, a second side surface 25 intersecting a second short side 13*b* of the substantially rectangular front end surface 11, a third side surface 35*a* intersecting a long side 14*a* of the substantially rectangular front end surface 11, and a fourth side surface 35*b* intersecting a second long side 14*b* of the substantially rectangular front end surface 11.

As shown in FIGS. 6, 7, and 9, the ink cartridges 100 are lengthwise mounted on the cartridge slots 7A to 7E so that the first side surface 15 and the second side surface 25 of each ink cartridge 100 are faced to the upside and downside, respectively.

Figure 16:
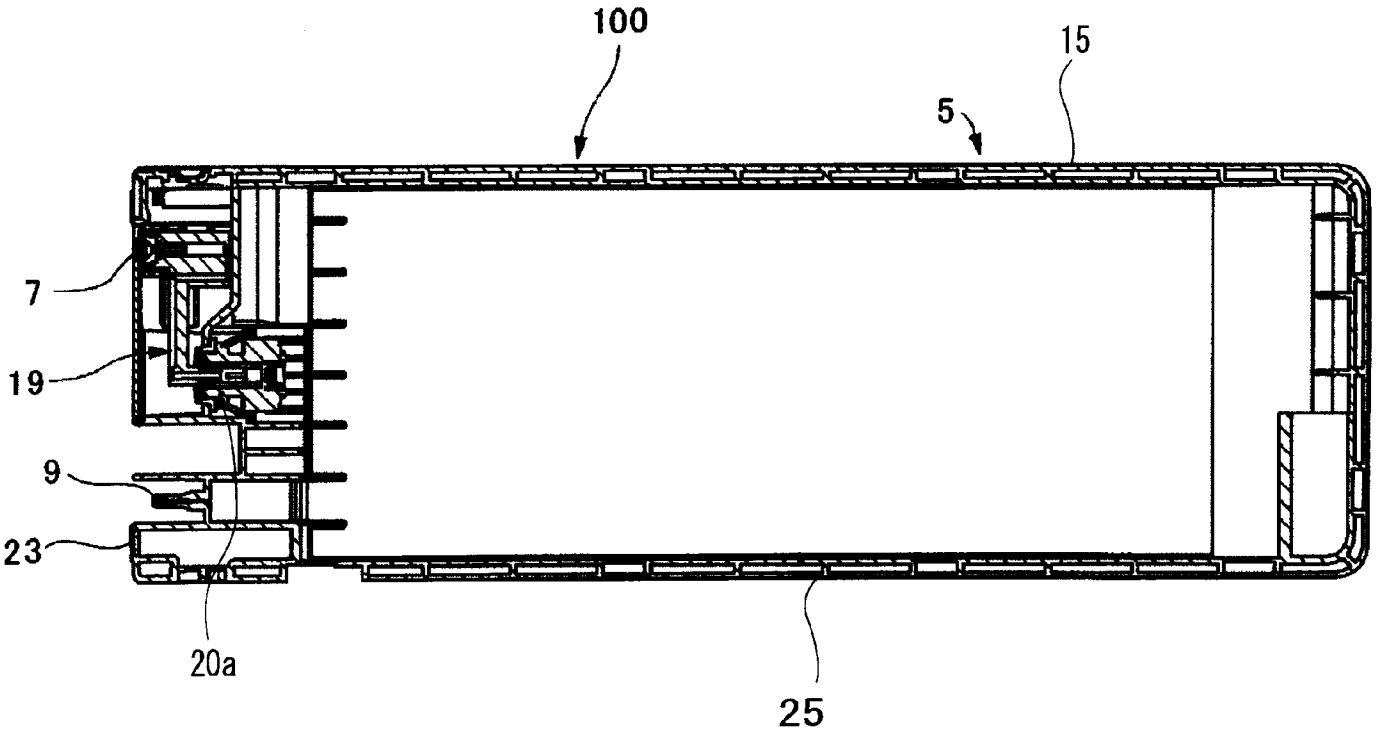
FIG. 16(*a*) is a top view illustrating the front end surface 11 of each ink cartridge 100.
Figure 16:
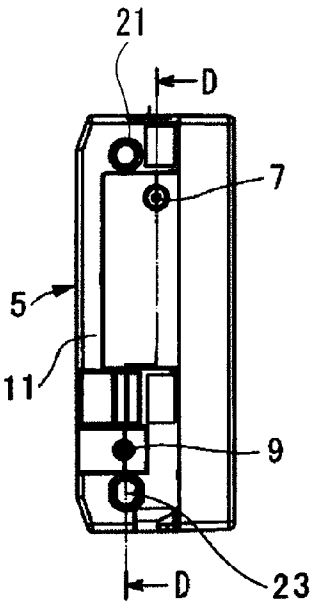

FIG. 16(*a*) is a top view illustrating the front end surface 11 of each ink cartridge 100. FIG. 16(*b*) is a diagram illustrating each ink cartridge 100 when viewed from an arrow D shown in FIG. 16(*a*).

As shown in FIGS. 8 and 16, the ink supply port 7, which is a liquid supply port, and an air inflow port 9 are formed in each front end surface 11. The ink supply port 7 is formed at a position closer to the side surface 15 than the center portion of the front end surface 11. The air inflow port 9 is formed at a position closer to the side surface 25 than the center portion of the front end surface 11. The ink supply port 7 is connected to the ink ejecting port 20*a* of the ink pack 4 (see FIG. 9). The ink ejecting port 20*a* is positioned near the center portion of the front end surface of the ink pack 4. That is, when the ink cartridges 100 are mounted on the cartridge slots 7A to 7E, each of the ink supply ports 7 is formed on an upper portion than the center portion in a height direction (vertical direction) of the ink pack 4. In addition, a flow passage 19 is formed between the ink supply port 7 and the ink ejecting port 20*a* to communicate therewith.

When the ink cartridges 100 are not mounted on the cartridge slots 7A to 7E, each ink supply port 7 is blocked by a valve or a sealing member. A pressure (static pressure) by which ink contained in the ink pack 4 is flown out from the ink supply port 7 is applied to the ink supply port 7. The larger an amount of ink contained in the ink pack 4 is, the larger the static pressure is. Accordingly, the static pressure (initial static pressure) is relatively high in a state where the ink is sufficiently filled. In addition, when the ink supply port 7 is opened in a state where the static pressure in the ink pack 4 is relatively high, the ink may flow out from the ink supply port 7.

However, if the ink supply port 7 is configured to be positioned above the center portion in the height direction (vertical direction) of the ink pack 4 according to this embodiment, the static pressure of the ink in the ink pack 4 becomes lower at a position at which the ink supply port 7 is disposed. Moreover, flow resistance caused by the flow passage 19 which connects the ink supply port 7 to the ink ejecting port 20*a*, or the like reduces the static pressure applied to the ink supply port 7. Accordingly, according to the embodiment, even when the ink cartridges 100 are attached to the cartridge slots 7A to 7E, ink is rarely leaked form the ink supply pins 249 when the ink supply pins 249 are inserted into the ink supply ports 7.

With reference to FIGS. 1, 3, 8, and 9, the ink supply from the ink packs 4 to the print head 225 will be described.

When the ink cartridges 100 are mounted on the cartridge slots 7A to 7E, the ink supply pins 249 described above are inserted into the ink supply ports 7. The ink supply pins 249 are connected to the print head 225 through the ink supply passages 223 and the valve units 224.

When the ink cartridges 100 are mounted on the cartridge slots 7A to 7E, the air inflow ports 9 are inserted into the air communicating ports 248 described above. The air communicating ports 248 are connected to the pressurizing pump 226 through the pressurization air supply passage 227. The pressurizing pump 226 can pressurize the ink packs 4 by supplying pressurization air to the bag accommodating portions 3 through the pressurization air supply passages 227, the air communicating ports 248, and the air inflow ports 9. By pressurizing each of the ink pack 4 in this way, the ink flowing out from the ink ejecting port 20*a* of each of the ink packs 4 is supplied to the print head 225 of the ink jet printing apparatus 211 through the ink supply port 7.

As shown in FIGS. 8 and 10, a pair of positioning holes 21 and 23 are formed on the front end surface 11 of each ink cartridge 100 so as to be spaced from each other. With reference to FIGS. 3, 8, and 9, the functions of the positioning holes 21 and 23 and the pair of positioning pins 247 described above will be described.

When the ink cartridges 100 are mounted on the cartridge slots 7A to 7E, the front ends of the positioning pins 247 are fitted to the positioning holes 21 and 23. Afterward, when the ink cartridges 100 are further inward inserted into the cartridge slots 7A to 7E, the ink cartridges 100 are moved on the basis of the positioning pins 247.

When the ink cartridges 100 are mounted on the cartridge slots 7A to 7E, the positioning holes 21 and 23 are fitted to the pair of positioning pins 247. At this time, since a direction of the front end surface 11 of each ink cartridge 100 is determined, the movement of each ink cartridge 100 in the direction along the front end surface 11 is regulated.

Moreover, as shown in FIG. 9, the pair of positioning holes 21 and 23, the circuit board 17, and the apparatus fixation structure 40 described blow are arranged on the substantial same vertical cross section taken along the line A-A (see FIG. 7).

According to this embodiment, as shown in FIGS. 8 and 10, one of the positioning holes 21 is configured to be a hollow hole which is a shape substantially corresponding to the sectional surface perpendicular to the shaft direction of the positioning pin 247. In addition, the other of the positioning holes 23 is configured to be a slim long hole in the height direction (arrow H direction in FIGS. 8 and 10, that is, a vertical direction) of the case 5. In this way, it is possible to maintain location precision, and thus easily allow size tolerance or the like by forming the positioning hole 23 with the long hole.

That is, when the ink cartridges 100 are mounted on the cartridge slots 7A to 7E, the location precision of the ink cartridges 100 in the cartridge slots 7A to 7E is maintained by the positioning hole 21 in the upper portion. Relative location deviation of the positioning hole 23 and the positioning pin 247 (see FIG. 3) due to size tolerance or the like is allowed by the positioning hole 23 in the lower portion. In addition, the ink takeout port 7 is formed in the vicinity of the positioning hole 21 in the upper portion, which maintains the location precision. Accordingly, the ink takeout port 7 and the ink supply pin 249 (see FIG. 3) are positioned with good precision.

As shown in FIGS. 8 and 9, the circuit board 17 is formed on the first side surface 15 of each ink cartridge 100. The circuit board 17 is formed at a position closer to the front end surface 11 than the rear end surface 12, in particular, adjacent to the front end surface 11. A memory element (not shown) for storing information such as an amount of residual ink or cartridge use history is mounted on the circuit board 17.

In the case 5, a residual quantity detecting sensor (which is a sensor using a piezoelectric element) (not shown) is formed in the midway of the flow passage 19 that allows an ink pack ejecting port (not shown) to be connected to the ink ejecting port 7. The residual quantity detecting sensor is a sensor for detecting an amount of residual ink in each ink cartridge 100. At least one electrode electrically connected to the residual quantity detecting sensor is formed on the circuit board 17.

As shown in FIG. 9, the apparatus terminal 250 is formed on the upper portion of each of the circuit boards 17. When the ink cartridges 100 are mounted on the cartridges slots 7A to 7E (see FIGS. 5 to 7), as described above, the contact point 17*a* of the electrode of each of the circuit boards 17 come in contact with a contact point 250*a* of the apparatus terminal 250 (see FIGS. 5 to 7). In this way, the electrode and the apparatus terminal 250 are electrically connected to each other.

Moreover, since each of the circuit board 17 is formed in the vicinity of the front end surface 11 and the positioning hole 23 in the upper portion for maintaining the location precision is formed in the vicinity of the first side surface 15, the contact point 17*a* of the circuit board 17 and the contact point 250*a* of the apparatus terminal 250 are positioned with high precision.

When the ink cartridges 100 are mounted on the cartridge holder 200 of the ink jet printing apparatus 211 (see FIG. 1) and the contact points 17*a* of the circuit boards 17 come in contact with the contact points 250*a* of the apparatus terminal 250 of the container mounting portions 1, the memory elements or the residual quantity detecting sensors are electrically connected to a control circuit of the ink jet printing apparatus 211 (see FIG. 1) through the circuit boards 17. An operation of the memory elements or the residual quantity detecting sensors can be controlled by the ink jet printing apparatus 211 (see FIG. 1).

As shown in FIGS. 6 to 8 and 10, a corner portion 27*a* corresponding to a side in which the first side surface 15 and the fourth side surface 35*b* of each ink cartridge 100 intersect each other and a corner portion 27*b* corresponding to a side in which the second surface 25 and the fourth side surface 35*b* intersect each other are formed in a notched shape in the insertion direction of the ink cartridges 100. That is, a pair of chamfered surfaces 29*a* and 29*b* are formed in the corner portions 27*a* and 27*b*, respectively. As shown in FIGS. 2, 3, and 5 to 7, there is no wall for partitioning boundaries between the ink cartridges 100 in the inside of the cartridge holder 200.

When the substantially rectangular flat ink cartridges 100 are accommodated lengthwise, that is, accommodated in parallel so that the first side surfaces 15 are faced upward and the second side surfaces 25 are faced downward, as shown in FIG. 6, the ink cartridges 100 are arranged in parallel so that the first side surfaces 35*a* and the fourth side surfaces 35*b* are opposed to each other between the plurality of adjacent ink cartridges 100. In addition, between the adjacent ink cartridges 100, the chamfered surfaces 29*a* and 29*b* of the ink cartridges 100 form triangular spaces 31*a* and 31*b* in a sectional view so as to extend in the insertion direction of the ink cartridges 100.

As shown in FIGS. 2, 3, 6, and 7, the guide rails 33, which are triangular guide protrusions in a sectional view corresponding to the lower portion-side shape 31*b* formed by the chamfered surfaces 29*b*, are formed in the insertion direction of the ink cartridges 100 in the cartridge holder 200. As shown in FIG. 5, the triangular guide protrusions 265 in a sectional view corresponding to the upper spaces 31*a* formed by the upper chamfered surfaces 29*a* are formed on the front side of the cartridge slots 7A to 7E. Accordingly, of the triangular spaces 31*a* and 31*b* in a sectional view, the lower-side spaces 31*b* are configured to be spaces for installing the guide rails 33 and the upper spaces 31*a* are configured to be spaces for installing the guide protrusions 265.

In the configuration in which the sectional triangular guide rails 33 corresponding to the chamfered surfaces 29*b* are arranged along the insertion direction of the ink cartridges 100, when the plurality of substantially rectangular flat ink cartridges 100 are arranged lengthwise in parallel, the substantially same triangular guide rails 33 in a sectional view can be arranged in the triangular spaces 31*b* in a sectional view formed in the lower portions between the adjacent ink cartridges 100 in the insertion direction of the ink cartridges 100.

Next, a configuration in which the ink cartridges 100 are fixed to the cartridge slots 7A to 7E will be described.

Figure 11:
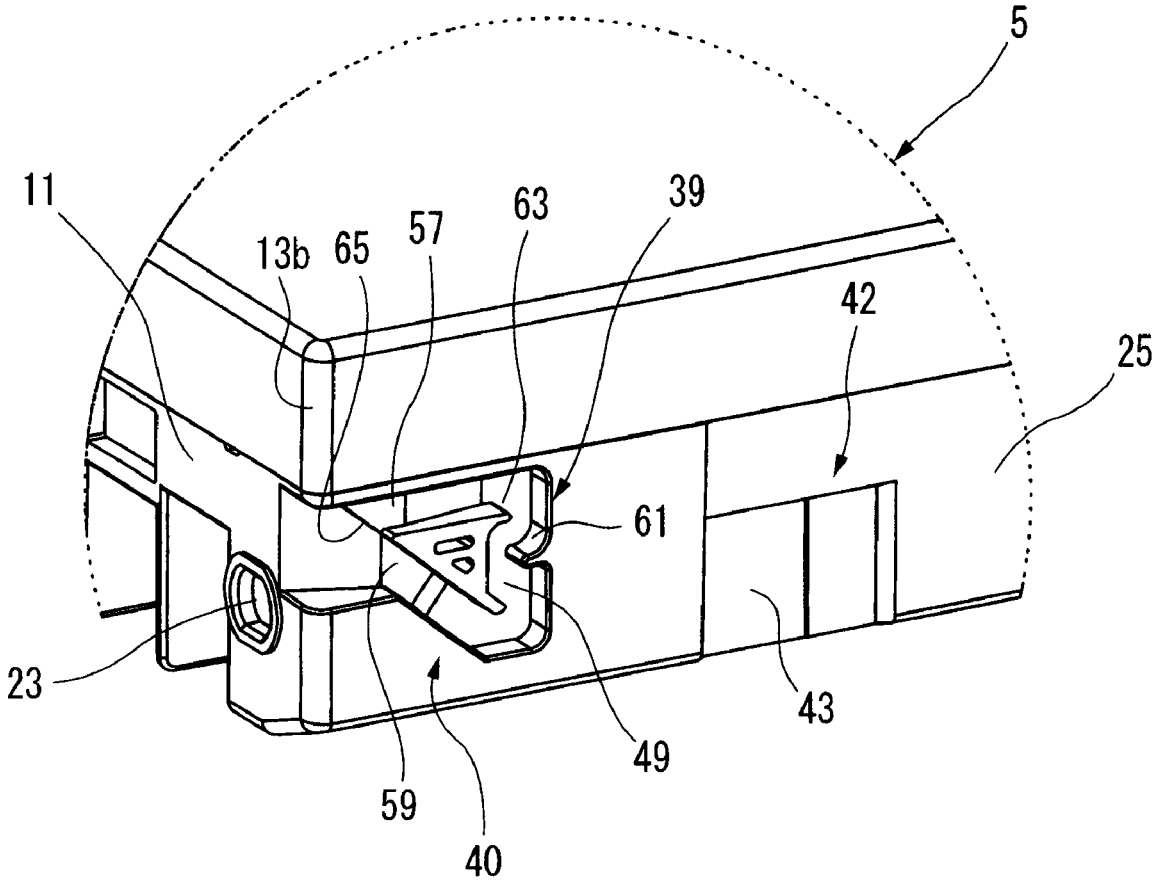
FIG. 11 is a partially enlarged view illustrating a B portion shown in FIG. 10.
Figure 12:
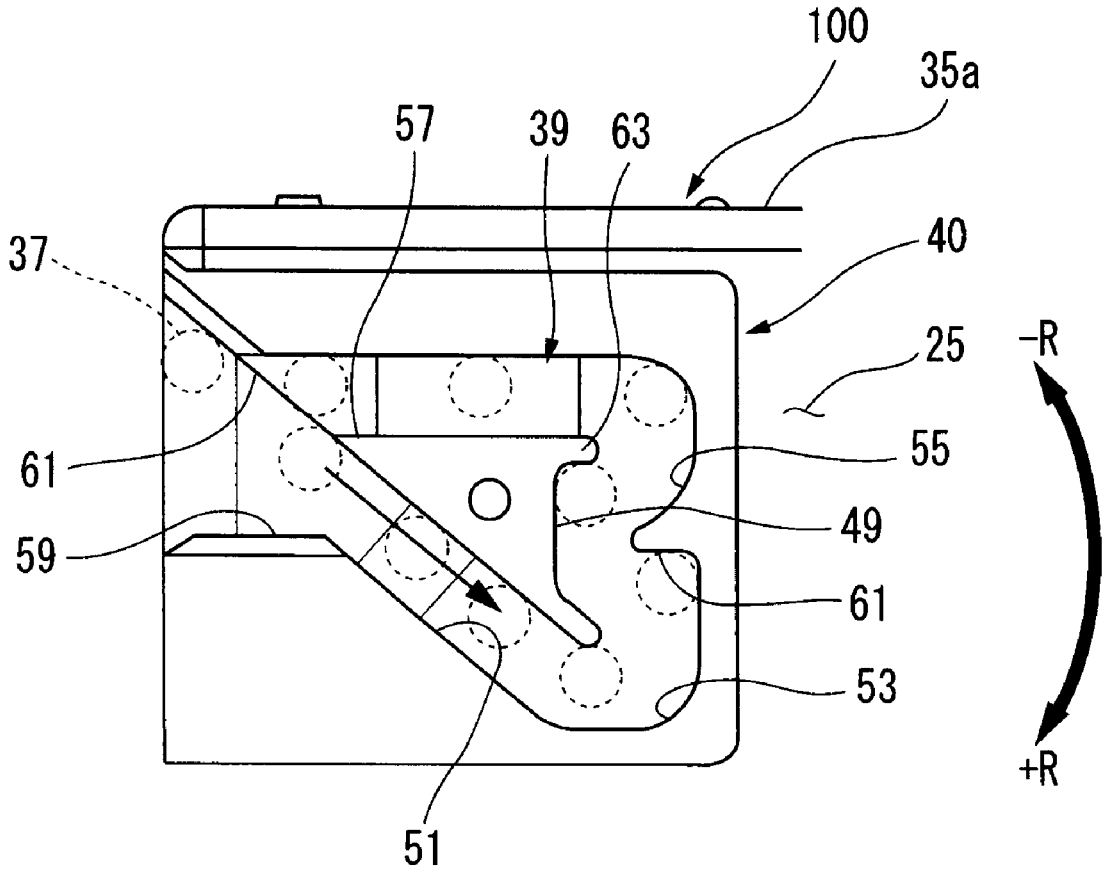
FIG. 12 is an enlarged top view illustrating a guide groove shown in FIG. 11.

FIG. 11 is a partly enlarged view illustrating a B portion shown in FIG. 10. FIG. 12 is an enlarged top view illustrating the guide groove shown in FIG. 11.

In the second side surface 25, as shown in FIGS. 10 and 11, there is formed a container fixation structure 40 for releasably regulating the movement of the ink cartridge in the direction opposite to the insertion direction of the ink cartridges 100 in cooperation with the apparatus fixation structure 50 formed in each of the cartridge slots 7A to 7E in the state where the ink cartridge 100 is mounted on the cartridge slots 7A to 7E against an urging force in the direction opposite to the insertion direction.

The apparatus fixation structure 40 is formed at a position closer to the front end surface 11 than the rear end surface 12, in particular, adjacent to the front end surface 11. In addition, on the second side surface 25, a concave portion 43 is formed at a position more away than the container fixation structure 40 from the front end surface 11. The concave portion 43 is not adjacent to the front end surface 11, but is formed at a position closer to the front end surface 11 than the rear end surface 12.

As shown in FIG. 12, the container fixation structure 40 includes a guide groove 39 into which the locking pin 37 of the apparatus fixation structure 50 (see FIG. 3) is inserted and which guides the locking pin 37, which is a locking member, to a lock position at the time the ink cartridges 100 are attached to or detached from the cartridge slots 7A to 7E. In the state where the ink cartridges 100 are mounted on the cartridge slots 7A to 7E, each container fixation structure 40 includes a locking portion 49 with which the locking pin 37 is engaged and which regulates the movement of the ink cartridge 100 in a pulling direction of each ink cartridge 100.

As shown in FIG. 12, each of the guide grooves 39 includes an entrance guide portion 51 for guiding the locking pin 37 at the time the ink cartridges 100 are inserted into the cartridge slots 7A to 7E, a midway guide portion 53 for guiding the locking pin 37 at the time the ink cartridges 100 inserted into the cartridge slots 7A to 7E return in the pulling direction, and an exit guide portion 55 for guiding the locking pin 37 taken out from the engagement portion 49 by pushing the ink cartridges 100 in the insertion direction at the time the ink cartridges 100 are detached from the cartridge slots 7A to 7E.

Since an exit portion 57 of the guide groove 39 is connected to an entrance portion 59, the guide groove 39 overall has a loop configuration. Since the groove depth of the exit portion 57 is shallower than that of the entrance portion 59 in a connection portion between the entrance portion 59 and the exit portion 57, an uneven portion 65 is formed in the connection portion. Each of the uneven portions 65 prevents the locking pin 37 from entering the exit portion 57 when the ink cartridges 100 are inserted into the cartridge slots 7A to 7E.

As shown in FIG. 9, the apparatus fixation structure 50 is formed blow the container fixation structure 40. As described above, the apparatus fixation structure 50 includes the lever member 45 and the spring 44 shown in FIG. 4(*b*).

The lever member 45 is urged in a fixed rotation direction by the spring 44. This direction is an arrow −R direction shown in FIG. 4(*b*) and a counterclockwise direction shown in FIG. 12. When the ink cartridges 100 are attached to or detached from the cartridge slots 7A to 7E, each of the locking pins 37 is inserted and guided to the guide groove 39 and the lever member 45 rotates in ±R directions along the shape of the guide groove 39.

As shown in FIG. 9, the locking pin 37 formed in the front end portion of the lever member 45 is formed in a direction intersecting the second side surface 25 of each ink cartridge 100. When the locking pin 37 is inserted into the guide groove 39, the locking pin 37 upward presses the bottom surface of the guide groove 39 by an elastic force of the lever main body 47 constituting the lever member 45.

Next, an operation of the locking pin 37 in the guide groove 39 at the time the ink cartridges 100 are attached or detached will be described with reference to FIG. 12.

When the ink cartridges 100 are inserted into the cartridge slots 7A to 7E and the ink cartridges 100 are further pushed against the urging force of the slider member 246 (see FIG. 3) in the insertion direction, each locking pin 37 is inserted into the entrance portion 59 of the guide groove 39.

The locking pin 37 is urged toward the direction of the bottom surface of the guide groove 39 by elastically deforming the lever main body 47 (see FIG. 4) of the lever member 45 (see FIG. 4). When the locking pin 37 moves beyond the longitudinal end portion of the entrance guide portion 51, the locking pin 37 is moved in the counterclockwise direction in FIG. 12 by the urging force of the spring 44 (see FIG. 4)

In addition, when the locking pin 37 collides with an interim stopping sidewall 61 and stops, the click sounds. The click sound allows a user to check that the ink cartridges 100 are sufficiently inserted.

Next, when the pressing pressure of the user in the insertion direction is released, the ink cartridges 100 moves back a little in the pulling direction due to the urging force of the slider member 246 (see FIG. 3). In this way, when the engagement of the locking pin 37 in the interim stop sidewall 61 is released, the locking pin 37 is moved in the counterclockwise direction by the urging force of the spring 44.

In addition, when the locking pin 37 collides with an end stop sidewall 63 formed in the locking portion 49 and stops at the lock position, the click sounds. The click allows the user to check that the ink cartridges 100 are fixed on the cartridge slots 7A to 7E (see FIG. 3). Moreover, even when the ink cartridges 100 are mounted on the cartridge slots 7A to 7E, the locking pins 37 press the bottom surface of the guide grooves 39 by the elastic force of the lever main body 47.

When each ink cartridge 100 is attached or detached, the engagement of the locking pin 37 in the end stop sidewall 63 is released by pushing the locked ink cartridge 100 and the locking pin 37 is relatively moved to a non-lock position along the exit guide portion 55 by the urging force of the lever member 45 generated by the spring 44. At this time, the ink cartridge 100 is pushed frontward by the urging force of the slider member 246 (see FIG. 3). The locking pin 37 is directed toward the exit portion 57 in accompaniment of the movement of the ink cartridge 100. Finally, by taking out each locking pin 37 from the corresponding exit portion 57, the ink cartridges 100 can be detached from the cartridge slot 7A to 7E.

In addition, as shown in FIGS. 10 and 11, the concave portion 43 is formed on the second side surface 25 of each ink cartridge 100, but does not have a special function. An example of the special function of the concave portion 43 will be described in the subsequent embodiment.

Next, a positional relation between the apparatus terminal 250 and the locking pin 37 at the time each ink cartridge 100 is mounted, that is, the locking pin 37 is locked to the locking portion 49 will be described mainly with reference to FIG. 9.

The apparatus terminal 250 includes the contact point 250*a* connected to the contact point 17*a* of the electrode of the circuit board 17 formed in the first side surface 15 of each ink cartridge 100. The contact point 250*a* is connected to the contact point 17*a* at a position closer to the front end surface 11 of each ink cartridge 100 by a distance S than the position at which the locking pin 37 is locked to the locking portion 49.

In this embodiment, as described above, the substantially rectangular flat ink cartridges 100 are lengthwise arranged in parallel as shown in FIG. 6. In addition, as shown in FIGS. 8 to 10, the circuit board 17 and the container fixation structure 40 are formed on the first side surface 15, which becomes the top surface, and the second side surface 25, which becomes the bottom surface, respectively. Accordingly, it is not necessary to form the apparatus terminal 250 or the apparatus fixation structure 50 between the adjacent ink cartridges 100, that is, between the third side surface 35*a* of one of the mutually adjacent ink cartridges 100 and the fourth side surface 35*b* of the other thereof. As a result, it is not necessary to ensure a space for forming the apparatus terminal 250 and the apparatus fixation structure 50 between the adjacent ink cartridges 100.

According to this embodiment, as shown in FIG. 9, the apparatus terminal 250 is formed above the circuit board 17 and the apparatus fixation structure 50 is below the container fixation structure 40. Accordingly, it is possible to closely accommodate the plurality of ink cartridges 100. In addition, as shown in FIG. 6, the total width size T for accommodating the ink cartridges 100 in the thickness direction t (direction of the short side of the front end surface 11) of the ink cartridges 100 becomes small and compact.

As shown in FIG. 9, the circuit board 17 and the container fixation structure 40 are formed on the side surfaces 15 and 25, respectively. Accordingly, it is easy to approach the contact point 250*a* of the apparatus terminal 250 to the contact point 17*a* of the circuit board 17. As a result, even when the plurality of ink cartridges 100 are lengthwise arranged, the electrical connection between the contact point 250*a* of the apparatus terminal 250 and the contact point 17*a* of the circuit board 17 does not deteriorate.

According to this embodiment, the first side surface 15 provided with the circuit board 17 and the apparatus terminal 250 are configured to be the top surface, and the second side surface 25 provided with the container fixation structure 40 and the apparatus fixation structure 50 are configured to be the bottom surface. However, the top and bottom surfaces may be reversed. However, in a case where the ink leaks between the ink supply port 7 and the ink supply pin 249, the configuration according to this embodiment is advantageous in that the electrical connection failure of the circuit board 17 caused due to the leaked ink can be prevented.

According to this embodiment, the circuit board 17, the positioning pin 21, and the ink supply port 7 are all integrated on the top surface. As described above, it is possible to improve the positional precision of the circuit board 17 and the apparatus terminal 250 and the positional precision of the ink supply port 17 and the ink supply pin 249 by closely disposing the circuit board 17, the positioning pin 21, and the ink supply port 7. In addition, since the ink supply port 7 is formed on the top surface, the ink ejecting port (not shown) of the ink pack 4 can be formed below the ink supply port 7. Accordingly, it is possible to reduce an initial static pressure. That is, like this embodiment, when the first side surface 15 and the second side surface 25 are configured to be the top surface and the bottom surface, respectively, it is easy to realize the configuration in which the positional precision of the circuit board 17 and the apparatus terminal 250 and the positional precision of the ink supply port 17 and the ink supply pin 249 can be improved and the initial static pressure can be reduced.

According to this embodiment, as shown in FIG. 9, the circuit board 17 and the container fixation structure 40 are formed closer to the front end surface 11 than the rear end surface 12. In addition, when the ink cartridges 100 are mounted on the cartridge slots 7A to 7E, the urging means of the apparatus fixation structure 50 urges the locking pin 37 so as to upward press the bottom surface of the guide groove 39 of the container fixation structure 40 by the top surface. That is, the second side surface 25, which becomes the bottom surface of the ink cartridge 100, is pressed toward the first side surface 15, which becomes the top surface of the ink cartridge 100, by the locking pin 37. Accordingly, the contact point 17*a* of the circuit board 17 formed on the first side surface 15 of the ink cartridge 100 is configured to press the apparatus terminal 250 of the ink jet printing apparatus 211 (the contact points 17*a* and 25*a* are closed to each other). Accordingly, the electrode of the circuit board 17 is reliably connected to the apparatus terminal 250.

In particular, according to this embodiment, as shown in FIG. 9, the contact point 250*a* comes in contact with the contact point 17*a* at a position closer to the front end surface 11 of the ink cartridge 100 by a gap S than the position at which the locking pin 37 is locked to the locking portion 49 when the ink cartridge 100 is mounted, that is, the locking pin 37 is locked to the locking portion 39. At this time, since the locking pin 37 of the apparatus fixation structure 50 upward press the bottom surface of the guide groove 39 of the container fixation structure 40, the front end surface 11 of the ink cartridge 100 rotates upward about the support portion 70 of the rear end surface 12.

The contact point 17*a* of the circuit board 17 formed on the first side surface 15 is pushed to the apparatus terminal 250, and the contact point 17*a* more moves to the apparatus terminal 250 than an amount of movement of the locking pin 37 to the bottom surface of the guide groove 39 of the container fixation structure 40. Accordingly, since the contact point 17*a* is configured to be firmly pressed toward the apparatus terminal 250, the electrode of the circuit board 17 and the apparatus terminal 250 are more reliably connected to each other.

According to this embodiment, as shown in FIG. 6, in the cartridge slots 7A to 7E, the plurality of ink cartridges 100 are arranged in parallel so that, of two adjacent ink cartridges 100, the third side surface 35*a* of one ink cartridge 100 and the fourth side surface 35*b* of the other ink cartridge 100 are opposed to each other. However, since the chamfered surface 29*b* is formed in each ink cartridge 100, the space 31*b* formed by the chamfered surface 29*b* can be used as a space for installing the guide rail 33.

It is not necessary to arrange the plurality of ink cartridges 100 so as to be spaced by the thickness of the guide rail 33. Accordingly, it is possible to accommodate the plurality of ink cartridges 100 so as to be closely arranged. As a result, since the total width size T for accommodating the ink cartridges 100 in the thickness direction t (direction of the short side of the front end surface 11) of the ink cartridges 100 becomes small and compact, it is possible to allow the size of the ink jet printing apparatus 211 to be smaller.

The sectional shape of the guide rails 33 or the guide protrusions 265 (see FIG. 5) is not limited to the triangle, but various sectional shapes may be used as long as the ink cartridges 100 can be inserted. Moreover, the shape of the chamfered surface may be appropriately modified in accordance with the sectional shape of the guide rails 33 or the guide protrusions 265.

The guide protrusion 265 (see FIG. 5) may be omitted, and in this case, the chamfered surface 29*a* corresponding to the guide protrusion 265 may be omitted. Moreover, in accordance with the shape or position of the guide protrusions 265 (see FIG. 5) or the guide rails 33, the chamfered surface 29*a* or 29*b* may be formed on the corner portion 27C (see FIGS. 8 and 10) corresponding to the side intersecting the third side surface 35*a* with the first side surface 15 or the corner portion 27*d* (see FIGS. 8 and 10) corresponding to the side intersecting the third side surface 35*a* and the second side surface 25. That is, the chamfered surface may be formed on at least one of four corner portions 27*a* to 27*d* corresponding to the sides intersecting two of the first to fourth side surfaces 15, 25, 35*a*, and 35*b*.

According to this embodiment, as shown in FIGS. 8 to 10, a pair of positioning holes 21 and 23 are formed in each ink cartridge 100. In addition, as shown in FIG. 3, a pair of positioning pins 247 fitted to the pair of positioning holes 21 and 23 are formed in the cartridge slots 7A to 7E.

Since the ink cartridges 100 can be mounted in the cartridge slots 7A to 7E at the exact inclination by the positioning holes 21 and 23 and the positioning pins 247, it is easier to mount the ink cartridges 100 in the cartridge slots 7A to 7E. Moreover, it is possible to prevent the circuit board 17, the apparatus terminal 250, the container fixation structure 40, and the apparatus fixation structure 50 from being broken due to the attachment or detachment of the ink cartridges 100 at erroneous inclination. Moreover, when the ink cartridges 100 are mounted in the cartridge slots 7A to 7E, it is possible to maintain good electrical connection between the circuit board 17 and the apparatus terminal 250 or to maintain good fixation between the container fixation structure 40 and the apparatus fixation structure 50.

According to this embodiment, as shown in FIG. 9, the pair of positioning holes 21 and 23, the circuit board 17, and the container fixation structure 40 are formed on the substantially same longitudinal surface A-A (see FIG. 7). With such a configuration, when the ink cartridge 100 are mounted on the cartridge slots 7A to 7E and the pair of positioning pins 247 are fitted in the pair of positioning holes 21 and 23, the ink cartridges 100 are positioned in a direction (that is, a direction parallel to the vertical cross section) along the front end surface 11. Accordingly, the contact point 17*a* of the circuit board 17 positioned on one side of the vertical cross section and the contact point 250*a* of the apparatus terminal 250 and the container fixation structure 40 and the apparatus fixation structure 50 positioned on the other thereof are positioned with high density in an approach direction or a separation direction.

According to this embodiment, as shown in FIG. 6, there is provided no wall for partitioning the ink cartridges 100 in the inside of the cartridge holder 200. Moreover, the ink cartridges 100 are arranged in parallel so that the third side surface 35*a* and the fourth side surface 35*b* are opposed to each other between the plurality of adjacent ink cartridges 100. Accordingly, it is possible to allow the total width size T for accommodating the ink cartridges 100 in the thickness direction t of the ink cartridges 100 to become smaller and more compact.

Next, an example of a function of concave portion 43 formed on the second side surface 25 will be described with reference to FIGS. 13 to 15. The non-mentioned details are the same as the above-described embodiment.

Figure 13:
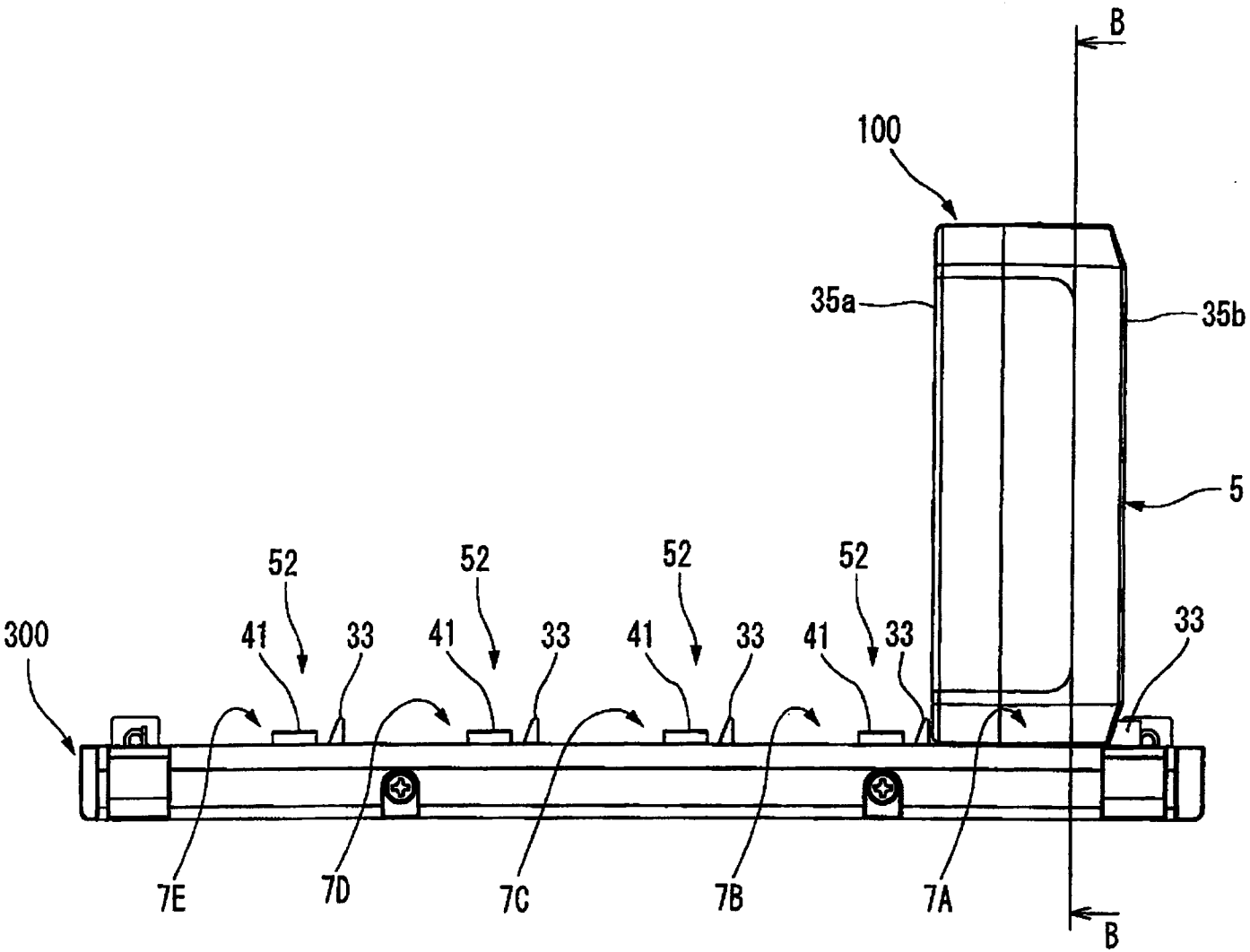
FIG. 13 is a front view illustrating a cartridge holder 300 mounted with some ink cartridges 100.

FIG. 13 is a front view illustrating a cartridge holder 300 mounted with some ink cartridges 100. FIG. 14 is a perspective view the cartridge holder 300 taken along the line B-B. FIG. 15 is an enlarged view illustrating a C portion shown in FIG. 14.

In the cartridge holder 300 shown in FIG. 13, there are provided jump prevention structures 52 capable of preventing the ink cartridges 100 from jumping out of the cartridge slots 7A to 7E in cooperation with the concave portions 43 when the ink cartridges 100 are mounted on the cartridge slots 7A to 7E against an urging force in a direction opposite to an insertion direction of the ink cartridges 100. As shown in FIG. 14, each apparatus jump prevention structure 52 is formed on the board 241. The cartridge holder 300 has the same configuration as that of the above-described cartridge holder 200 except for the formation of the apparatus jump prevention structure 52.

Figure 14:
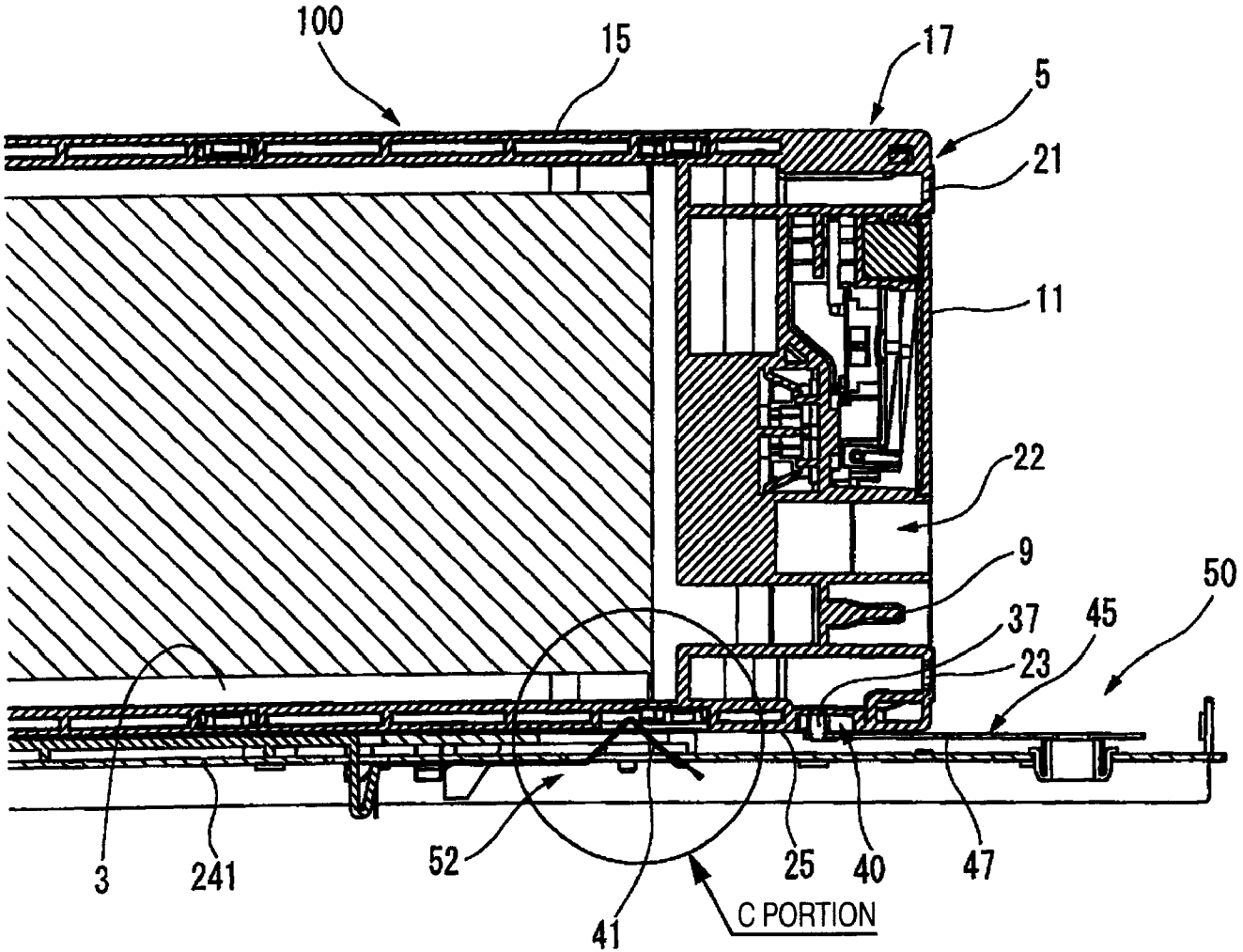
FIG. 14 is a perspective view the cartridge holder taken along the line B-B shown in FIG. 13.
Figure 15:
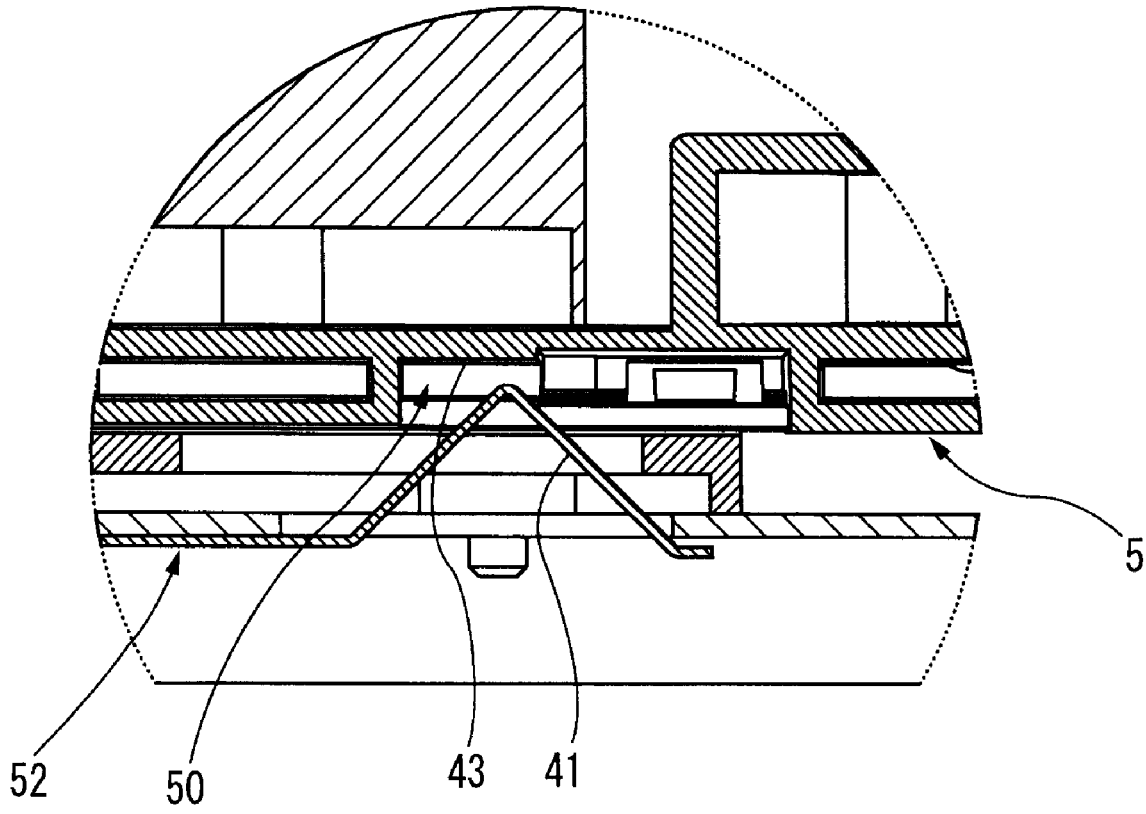
FIG. 15 is an enlarged view illustrating a C portion shown in FIG. 14.

As shown in FIGS. 14 and 15, each apparatus jump prevention structure 52 has a locking spring 41 with a convex shape. The engagement of the convex locking spring 41 with the concave portion 43 deters each ink cartridge 100 from coming off when the ink cartridge 100 are detached from the cartridge slots 7A to 7E.

That is, as far as the cartridge holder 300 according this embodiment is concerned, the ink cartridges 100 are urged in the direction opposite to the insertion direction by the slider member 246 (see FIG. 3) to be discharged at a predetermined speed at the time the ink cartridges 100 are detached from the cartridge slots 7A to 7E. At this time, by engaging the convex locking spring 41 with the concave portion 43, a movement of the ink cartridges 100 is regulated. Accordingly, it is possible to prevent the ink cartridges 100 from be rushed out from the cartridge slots 7A to 7E.

According to this embodiment, the same advantage as the foregoing embodiment can be gained as well. In addition, the modified examples of the foregoing embodiment can be applied to this embodiment.

This application claims priority from Japanese Patent Application No. 2006-300935 filed on Nov. 6, 2006, the entire disclosure of which are expressly incorporated by reference herein.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the sprit and scope of the invention.

What is claimed is:

1. A liquid container constructed and arranged to be detachably mounted on a container mounting portion of a liquid consuming apparatus, comprising:

a container body for storing a liquid to be supplied to the liquid consuming apparatus and having a substantially rectangular front end surface, in an insertion direction, with two short sides and two long sides, a first side surface perpendicular to the front end surface at one of the short sides, a second side surface perpendicular to front end surface at the other short side and a rear end surface opposite the front end surface, wherein the long sides and short sides of the front end surface are substantially shorter than the length in the insertion direction of the first side surface and the second side surface;

a liquid supply port for sending out the liquid to be supplied to the liquid consuming apparatus, the liquid supply port formed on the front end surface;

a circuit board having a contact point for making contact with the liquid consuming apparatus, the circuit board formed on the first side surface; and a container fixation structure for releasably regulating a movement of the container body in a direction opposite to the insertion direction thereof in cooperation with an apparatus fixation structure formed on the container mounting portion and that is formed on the second side surface in a state where the container body is mounted on the container mounting portion against an urging force in the direction opposite to the insertion direction;

wherein the container fixation structure comprises a guide groove for guiding a locking pin of the apparatus fixation structure, the guide groove being formed on the second side surface at a position closer to the front end surface than the rear end surface and comprising a bottom surface and a loop configuration that includes an entrance guide portion, a midway guide portion, an exit guide portion and a locking portion, wherein the bottom surface is adapted to be pressed by the locking pin toward the first side surface.

2. The liquid container according to claim 1, wherein the circuit board and the container fixation structure are formed at positions closer to the front end surface than the rear end surface, wherein the first side surface is disposed at a top surface and the second side surface is disposed at a bottom surface in the state where the container body is mounted on the container mounting portion, wherein the container body includes a third side surface and a fourth side surface and the third and fourth side surfaces are substantially rectangular in shape, extend perpendicularly to the two long sides of the front end surface and are the two largest surfaces of the container body, and wherein the container fixation structure is constructed and arranged to be pressed toward the top surface by the apparatus fixation structure.

3. The liquid container according to claim 2, wherein the contact point of the circuit board is formed at a position closer to the front end surface in the insertion direction than a position at which a locking member of the apparatus fixation structure is locked to a locking portion of the container fixation structure.

4. The liquid container according to claim 1, wherein a concave portion is formed on the second side surface perpendicular to the other short side of the front end surface so as to be positioned more away from the front end surface than the container fixation structure.

5. The liquid container according to claim 4, wherein the concave portion prevents the container body from jumping out of the container mounting portion in cooperation with an apparatus jump prevention structure formed on the container mounting portion.

6. The liquid container according to claim 1, wherein a chamfered surface on which a notch is formed in the insertion direction is disposed on a corner portion corresponding to a side perpendicular to the front end surface, the corner portion extending in the insertion direction.

7. The liquid container according to claim 1, wherein the front end surface includes a pair of positioning holes which are spaced from each other on the front end surface and which regulate a movement of the container body in a direction along the front end surface by fitting a pair of positioning pins formed on a surface of the container mounting portion to be opposed to the front end surface.

8. The liquid container according to claim 7, wherein the pair of positioning holes on the front end surface, the circuit board on the first side surface and the container fixation structure on the second side surface are disposed substantially on the same cross section of the container body taken through the front end surface, the first side surface, and the second side surface of the container body.

9. A container holder of a liquid consuming apparatus comprising a plurality of container mounting portions each of which is mounted with the liquid container according to claim 6, wherein a guide protrusion corresponding to the shape of the notch on the corner portion of the liquid container is disposed on each of the container mounting portions in the insertion direction of the container body.

10. The container holder according to claim 9, wherein the container mounting portions are arranged in parallel so that side surfaces perpendicular to the front end surfaces of the liquid containers at the long sides are opposed to each other among the adjacent container bodies.

11. A liquid consuming apparatus comprising:

a liquid ejecting head for ejecting a liquid;

a plurality of container mounting portions adapted to be mounted with the plurality of liquid containers according to claim 1 so that the first side surface becomes a top surface and the second side surface becomes a bottom surface;

an apparatus terminal adapted to be coming in contact with a contact point of the electrode of the liquid container, the apparatus terminal disposed on each of the container mounting portion, so that the apparatus terminal adapted to be disposed above the circuit board of the liquid container when each liquid container is mounted; and an apparatus fixation structure having a locking pin adapted to be guided by the guide groove of the liquid container, the apparatus fixation structure disposed on each of the container mounting portions, so that the apparatus fixation structure is disposed below the container fixation structure when each liquid container is mounted.

12. A liquid consuming apparatus comprising:

a liquid ejecting head for ejecting a liquid;

a plurality of container mounting portions adapted to be mounted with the plurality of liquid containers according to claim 2, so that the first side surface becomes the top surface and the second side surface becomes the bottom surface;

an apparatus terminal adapted to be coming in contact with a contact point of the electrode of the liquid container, the apparatus terminal disposed on each of the container mounting portions, so that the apparatus terminal adapted to be disposed above the circuit board of the liquid container when each liquid container is mounted; and an apparatus fixation structure having a locking pin adapted to be guided by the guide groove of the liquid container and urged to press the bottom surface of the guide groove, the apparatus fixation structure disposed on each of the container mounting portions, so that the apparatus fixation structure is adapted to be disposed below the container fixation structure of the liquid container and presses the bottom surface of the guide groove toward the top surface when each liquid container is mounted.

13. The liquid consuming apparatus according to claim 12, wherein the apparatus terminal comes in contact with the contact point at a position closer to the front end surface than a position at which a locking member of the apparatus fixation structure is locked to the locking portion of the container fixation structure in the state where the liquid container is mounted on the container mounting portion.

14. A liquid consuming apparatus comprising:

a liquid ejecting head for ejecting a liquid;

a plurality of container mounting portions adapted to be mounted with the plurality of liquid containers according to claim 4, so that the first side surface becomes the top surface and the second side surface becomes the bottom surface;

an apparatus terminal adapted to be coming in contact with a contact point of the electrode of the liquid container, the apparatus terminal disposed on each of the container mounting portions, so that the apparatus terminal is adapted to be disposed above the circuit board of the liquid container when each liquid container is mounted;

an apparatus fixation structure having a locking pin adapted to be guided by the guide groove of the liquid container and urged to press the bottom surface of the guide groove, the apparatus fixation structure disposed on each of the container mounting portions, so that the apparatus fixation structure is adapted to be disposed below the container fixation structure of the liquid container when each liquid container is mounted; and an apparatus jump prevention structure adapted to engage with the concave portion of the liquid container when each container is mounted, the apparatus jump prevention structure disposed in each container mounting portion.

15. A liquid consuming apparatus comprising:

a liquid ejecting head for ejecting a liquid., a plurality of container mounting portions adapted to be mounted with the plurality of liquid containers according to claim 6, so that the first side surface becomes the top surface and the second side surface becomes the bottom surface;

an apparatus terminal adapted to be coming in contact with a contact point of the electrode of the liquid container, the apparatus terminal disposed on each of the container mounting portions, so that the apparatus terminal is adapted to be disposed above the circuit board of the liquid container when each liquid container is mounted;

an apparatus fixation structure having a locking pin adapted to be guided by the guide groove of the liquid container and urged to press the bottom surface of the guide groove, the apparatus fixation structure disposed on each of the container mounting portions, so that the apparatus fixation structure is adapted to be disposed below the container fixation structure of the liquid container when each liquid container is mounted; and a guide protrusion corresponding to a shape of the notch of the liquid container disposed on each of the container mounting portions in the insertion direction of the liquid container.

16. A liquid consuming apparatus comprising:

a liquid ejecting head for ejecting a liquid;

a plurality of container mounting portions adapted to be mounted with the plurality of liquid containers according to claim 7, so that the first side surface becomes the top surface and the second side surface becomes the bottom surface;

an apparatus terminal adapted to come in contact with a contact point of the electrode of the liquid container, the apparatus terminal disposed on each of the container mounting portions, so that the apparatus terminal is adapted to be disposed above the circuit board of the liquid container when each liquid container is mounted;

an apparatus fixation structure having a locking pin adapted to be guided by the guide groove of the liquid container and urged to press the bottom surface of the guide groove, the apparatus fixation structure disposed on each of the container mounting portions, so that the apparatus fixation structure is adapted to be disposed below the container fixation structure of the liquid container when each liquid container is mounted; and a pair of positioning pins adapted to be fitted in the pair of positioning holes to regulate a movement of the liquid container in a direction along the front end surface of the liquid container, the pair of positioning pins formed on each of the container mounting portions.

17. The liquid consuming apparatus according to claim 12, wherein the plurality of container mounting portions are arranged in parallel so that the third side surface of one of two adjacent liquid containers is opposed to the fourth side surface of the other thereof.

18. A liquid consuming apparatus comprising:

a liquid ejecting head for ejecting a liquid;

a plurality of container mounting portions adapted to be mounted with the plurality of liquid containers according to claim 1 so that the first side becomes the bottom surface and the second side surface becomes the top surface;

an apparatus terminal adapted to be coming in contact with a contact point of the electrode of the liquid container, the apparatus terminal disposed on each of the container mounting portions, so that the apparatus terminal adapted to be disposed below the circuit board of the liquid container when each liquid container is mounted; and an apparatus fixation structure having a locking pin adapted to be guided by the guide groove of the liquid container and urged to press the bottom surface of the guide groove, the apparatus fixation structure disposed on each of the container mounting portions, so that the apparatus fixation structure adapted to be disposed above the container fixation structure of the liquid container when each liquid container is mounted.

* * * * *

UNITED STATES PATENT AND TRADEMARK OFFICE

CERTIFICATE OF CORRECTION

PATENT NO. : 8,091,995 B2
APPLICATION NO. : 11/855263
DATED : January 10, 2012
INVENTOR(S) : Izumi Nozawa et al.

It is certified that error appears in the above-identified patent and that said Letters Patent is hereby corrected as shown below:

Column 22

Line 58, delete “circuit board” and replace with -- contact point --.

Column 23

Line 12, delete “circuit board” and replace with -- contact point --.

Signed and Sealed this
Fourteenth Day of February, 2012

David J. Kappos

David J. Kappos
*Director of the United States Patent and Trademark Office*